US009282615B2

(12) United States Patent
Yamagishi et al.

(10) Patent No.: US 9,282,615 B2
(45) Date of Patent: Mar. 8, 2016

(54) METHODS FOR PRODUCING ELECTROPHOTOGRAPHIC PHOTOSENSITIVE MEMBER AND ORGANIC DEVICE EACH HAVING CHARGE TRANSPORTING LAYER

(71) Applicant: CANON KABUSHIKI KAISHA, Tokyo (JP)

(72) Inventors: Keiko Yamagishi, Kawasaki (JP); Atsushi Okuda, Yokohama (JP); Kimihiro Yoshimura, Yokohama (JP); Harunobu Ogaki, Suntou-gun (JP); Yohei Miyauchi, Tokyo (JP); Hiroki Uematsu, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/359,563

(22) PCT Filed: Dec. 6, 2012

(86) PCT No.: PCT/JP2012/082265

§ 371 (c)(1),
(2) Date: May 20, 2014

(87) PCT Pub. No.: WO2013/094497

PCT Pub. Date: Jun. 27, 2013

(65) Prior Publication Data

US 2014/0322434 A1 Oct. 30, 2014

(30) Foreign Application Priority Data

Dec. 22, 2011 (JP) ..... 2011-282086
Nov. 21, 2012 (JP) ..... 2012-255351

(51) Int. Cl.

| | |
|---|---|
| ***H05B 33/10*** | (2006.01) |
| ***G03G 5/047*** | (2006.01) |
| ***G03G 5/05*** | (2006.01) |

(52) U.S. Cl.
CPC ..... *H05B 33/10* (2013.01); *G03G 5/047* (2013.01); *G03G 5/0503* (2013.01); *G03G 5/0514* (2013.01); *G03G 5/0525* (2013.01)

(58) Field of Classification Search
CPC ..... G03G 5/047
See application file for complete search history.

(56) References Cited

U.S. PATENT DOCUMENTS 5,531,872 A 7/1996 Forgit et al.
5,928,831 A * 7/1999 Nakamura ..... 430/137.14

(Continued)

FOREIGN PATENT DOCUMENTS

EP 2 172 810 A1 4/2010
EP 2 253 681 A1 11/2010

(Continued)

OTHER PUBLICATIONS

Okuda, et al., U.S. Appl. No. 14/353,463, filed Apr. 22, 2014.

(Continued)

*Primary Examiner* — Nathan T Leong
(74) *Attorney, Agent, or Firm* — Fitzpatrick, Cella, Harper and Scinto

(57) ABSTRACT

A method for producing an electrophotographic photosensitive member has a charge transporting layer, including preparing a first solution containing a specified first liquid, a charge transporting substance and a binder resin, preparing a second solution containing a specified second liquid and water, preparing an emulsion from the first and second solutions, forming the emulsion coating, and heating the coat to form the charge transporting layer, and a method for producing an organic device has a charge transporting layer, including preparing a first solution containing a specified first liquid and a charge transporting substance, preparing a second solution containing a specified second liquid and water, preparing an emulsion from the first and second solutions, forming the emulsion coating, and heating the coat to form the charge transporting layer are used.

16 Claims, 1 Drawing Sheet

(56) References Cited

U.S. PATENT DOCUMENTS

| | | | | |
|---|---|---|---|---|
| 7,629,102 | B2 | 12/2009 | Ochi et al. | |
| 2008/0199794 | A1* | 8/2008 | Uesugi et al. | 430/66 |
| 2009/0023091 | A1* | 1/2009 | Ochi et al. | 430/133 |

FOREIGN PATENT DOCUMENTS

| | | | |
|---|---|---|---|
| JP | 7-313915 | A | 12/1995 |
| JP | 2005-310408 | A | 11/2005 |
| JP | 2007-79555 | A | 3/2007 |
| JP | 2007-87847 | A | 4/2007 |
| JP | 2009-288401 | A | 12/2009 |
| JP | 2011-128213 | A | 6/2011 |
| WO | 2009/011072 | A1 | 1/2009 |

OTHER PUBLICATIONS

Okuda, et al., U.S. Appl. No. 14/304,172, filed Jun. 13, 2014.
PCT International Search Report and Written Opinion of the International Searching Authority, International Application No. JP2012/082265, Mailing Date Feb. 5, 2013.
European Search Report dated Jul. 15, 2015 in European Application No. 12860114.3.

* cited by examiner

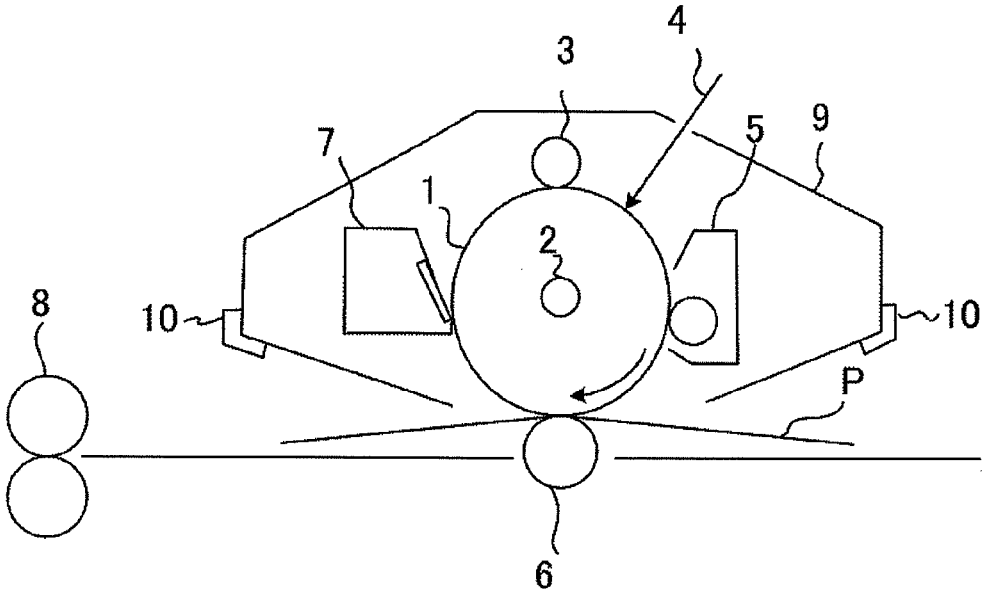
4
3
7
5
9
1
2
8
10
10
P
6

METHODS FOR PRODUCING ELECTROPHOTOGRAPHIC PHOTOSENSITIVE MEMBER AND ORGANIC DEVICE EACH HAVING CHARGE TRANSPORTING LAYER

TECHNICAL FIELD

The present invention relates to a method for producing an electrophotographic photosensitive member and a method for producing an organic device.

BACKGROUND ART

Organic devices having a charge transporting layer in a part thereof are studied, developed, and produced in many fields such as organic electroluminescent elements, organic EL elements, solar cells, actuators, organic sensors, electronic paper, touch panels and electrophotographic photosensitive members. Organic devices having a charge transporting layer are often provided with a thin film formed by coating a substrate with a coating solution with a charge transporting substance dissolved in an organic solvent. Also for a method for producing an electrophotographic photosensitive member that is one of organic devices, a method is generally used in which a coating liquid with a charge transporting substance dissolved in an organic solvent is made and applied onto a support. A charge transporting layer is often demanded for having durability, among the respective layers of a laminate type electrophotographic photosensitive member, and a coat of the layer has a thicker film thickness than other layers. Therefore, the amount of a coating liquid used is larger, thereby resulting in a charge transporting layer in which a large amount of an organic solvent is used. In order to reduce the amount of an organic solvent in producing an electrophotographic photosensitive member, it is desirable to reduce the amount of an organic solvent for use in a coating liquid for a charge transporting layer. However, in order to make the coating liquid for a charge transporting layer, a halogen solvent and an aromatic organic solvent are required to be used because of highly dissolving a charge transporting substance and a resin, and thus the amount of an organic solvent is reduced with difficulty.

PTL 1 relates to a coating material for forming a charge transporting layer and reports an approach for the purpose of reducing the amount of an organic solvent for reducing a volatile substance and carbon dioxide. This Literature discloses making of an emulsion for a charge transporting layer by charging into water an organic solution with substances contained in a charge transporting layer dissolved in an organic solvent and forming oil drops in this water.

CITATION LIST

Patent Literature

PTL 1: Japanese Patent Application Laid-Open No. 2011-128213

SUMMARY OF INVENTION

Technical Problem

However, the present inventors have reviewed and as a result, have found that in the method for producing an electrophotographic photosensitive member disclosed in PTL 1, in which the emulsion is prepared, although a uniform emulsion state is achieved just after preparing the emulsion, deterioration in liquid properties of the emulsion is observed after the emulsion is left to stand for a long time. It has also been found that a film obtained by leaving the emulsion to stand for a long time, thereafter applying the emulsion and then drying the resultant is insufficient in terms of uniformity.

The reason for this is considered that the organic solution with substances contained in a charge transporting layer dissolved in an organic solvent coalesces in water over time to hardly form a stable emulsified state, thereby causing aggregation and precipitation. A further improvement is demanded in terms of reducing the amount of an organic solvent and at the same time securing the stability of the coating liquid for a charge transporting layer.

Solution to Problem

An object of the present invention is to provide a method for producing an electrophotographic photosensitive member, in particular, a method for producing an electrophotographic photosensitive member, that reduces the amount of an organic solvent for use in a coating liquid for a charge transporting layer and at the same time enhances the stability of the coating liquid after storage for a long time, thereby enabling forming a charge transporting layer having a high film uniformity, in a method for forming a charge transporting layer.

Another object of the present invention is to provide a method for producing an organic device, in particular, a method for producing an organic device, that reduces the amount of an organic solvent for use in a coating liquid for a charge transporting layer and at the same time enhances the stability of the coating liquid after storage for a long time, thereby enabling forming a charge transporting layer having a high film uniformity, in a method for forming a charge transporting layer.

Advantageous Effects of Invention

The above objects are achieved by the following present invention.

The present invention relates to a method for producing an electrophotographic photosensitive member which has a support and a charge transporting layer formed thereon, the production method including the steps of; preparing a first solution containing; a first liquid having a solubility in water at 25° C. and 1 atm of 1.0 mass % or less, a charge transporting substance, and a binder resin, preparing a second solution containing; a second liquid having a solubility in water at 25° C. and 1 atm of 5.0 mass % or more and a solubility in the first liquid at 25° C. and 1 atm of 5.0 mass % or more, and water, dispersing the first solution in the second solution to prepare an emulsion, forming a coat of the emulsion, and heating the coat to form the charge transporting layer.

The present invention also relates to a method for producing an organic device which has a charge transporting layer, the production method including the steps of; preparing a first solution containing; a first liquid having a solubility in water at 25° C. and 1 atm of 1.0 mass % or less, a charge transporting substance, and a binder resin preparing a second solution containing; a second liquid having a solubility in water at 25° C. and 1 atm of 5.0 mass % or more and a solubility in the first liquid at 25° C. and 1 atm of 5.0 mass % or more, and water, dispersing the first solution in the second solution to prepare an emulsion, forming a coat of the emulsion, and heating the coat to form the charge transporting layer.

The present invention also relates to a method for producing an electrophotographic photosensitive member which has a support and a charge transporting layer formed thereon, the production method including the steps of; preparing a first solution containing; a first liquid, a charge transporting substance, and a binder resin, preparing a second solution containing; a second liquid, and water, dispersing the first solution in the second solution to prepare an emulsion, forming a coat of the emulsion, and heating the coat to form the charge transporting layer, and wherein the first liquid is at least one selected from the group consisting of toluene, chloroform, dichlorobenzene, chlorobenzene, xylene, ethylbenzene and phenetole, and the second liquid is at least one selected from the group consisting of tetrahydrofuran, dimethoxymethane, 1,2-dioxane, 1,3-dioxane, 1,4-dioxane, 1,3,5-trioxane, methanol, 2-pentanone, ethanol, tetrahydropyran, diethylene glycol dimethyl ether, ethylene glycol dimethyl ether, propylene glycol n-butyl ether, propylene glycol monopropyl ether, ethylene glycol monomethyl ether, diethylene glycol monoethyl ether, ethylene glycol monoisopropyl ether, ethylene glycol monobutyl ether, ethylene glycol monoisobutyl ether, ethylene glycol monoallyl ether, propylene glycol monomethyl ether, dipropylene glycol monomethyl ether, tripropylene glycol monomethyl ether, propylene glycol monobutyl ether, propylene glycol monomethyl ether acetate, diethylene glycol methyl ethyl ether, diethylene glycol diethyl ether, dipropylene glycol dimethyl ether, propylene glycol diacetate, methyl acetate, ethyl acetate, n-propyl alcohol, 3-methoxybutanol, 3-methoxybutyl acetate, and ethylene glycol monomethyl ether acetate.

According to the present invention, the methods for producing an electrophotographic photosensitive member and an organic device each having a charge transporting layer having a high film uniformity, the methods enhancing the stability of the coating liquid for a charge transporting layer (emulsion) after storage for a long time, in methods for producing an electrophotographic photosensitive member and an organic device, can be provided.

Further features of the present invention will become apparent from the following description of exemplary embodiments with reference to the attached drawing.

BRIEF DESCRIPTION OF DRAWING

FIG. 1 is a view illustrating one example of a schematic configuration of an electrophotographic apparatus provided with a process cartridge having an electrophotographic photosensitive member of the present invention.

DESCRIPTION OF EMBODIMENTS

Preferred embodiments of the present invention will now be described in detail in accordance with the accompanying drawing.

The method for producing an electrophotographic photosensitive member of the present invention is a method for producing an electrophotographic photosensitive member which has a charge transporting layer, as described above, the production method including the steps of; preparing a first solution containing; a first liquid having a solubility in water at 25° C. and 1 atm of 1.0 mass % or less, a charge transporting substance, and a binder resin, preparing a second solution containing; a second liquid having a solubility in water at 25° C. and 1 atm of 5.0 mass % or more and a solubility in the first liquid at 25° C. and 1 atm of 5.0 mass % or more, and water, dispersing the first solution in the second solution to prepare an emulsion, forming a coat of the emulsion, and heating the coat to form the charge transporting layer.

The method for producing an organic device of the present invention is a method for producing an organic device which has a charge transporting layer, as described above, the production method including the steps of; preparing a first solution containing; a first liquid having a solubility in water at 25° C. and 1 atm of 1.0 mass % or less, a charge transporting substance, a binder resin preparing a second solution containing; a second liquid having a solubility in water at 25° C. and 1 atm of 5.0 mass % or more and a solubility in the first liquid at 25° C. and 1 atm of 5.0 mass % or more, and water, preparing an emulsion from the first solution and the second solution, forming a coat of the emulsion, and heating the coat to form the charge transporting layer.

Hereinafter, the method for producing an electrophotographic photosensitive member which has a charge transporting layer of the present invention will be described.

First, the first solution containing a first liquid, a charge transporting substance and a binder resin will be described.

The charge transporting substance for use in the charge transporting layer can be a substance having hole transporting ability (hole transporting substance), and examples of the hole transporting substance include a triarylamine compound or a hydrazone compound. In particular, the hole transporting substance can be a triarylamine compound from the viewpoints of electrophotographic characteristics of an electrophotographic photosensitive member and high hole transporting ability (hole transferring ability) of an organic device.

Hereinafter, specific examples of the charge transporting substance will be represented, but are not limited to the following.

(1-1)

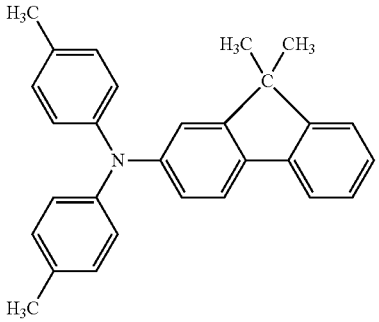

(1-2)

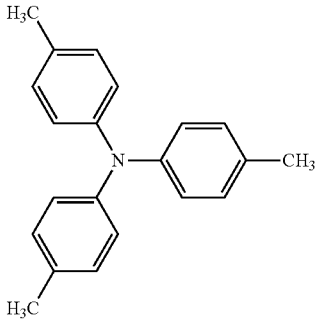

-continued
(1-3)
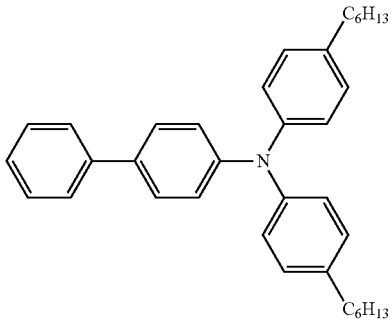
(1-4)
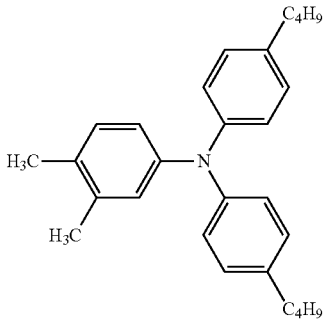
(1-5)
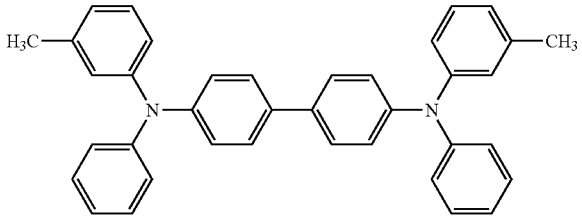
(1-6)
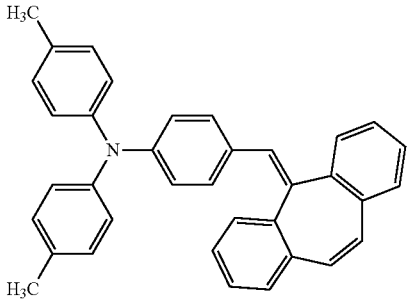
(1-7)
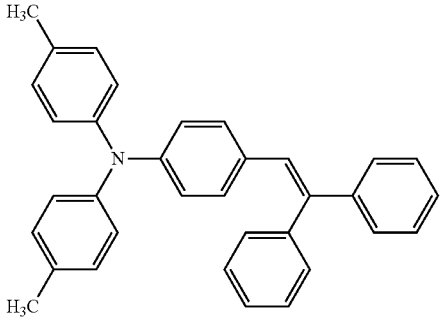
(1-8)
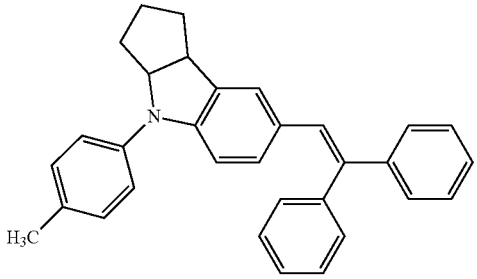
(1-9)
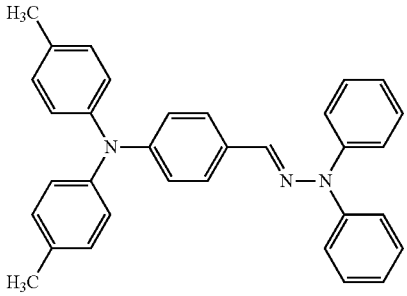
(1-10)
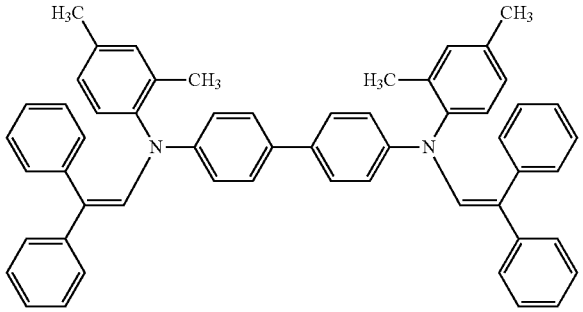
(1-11)
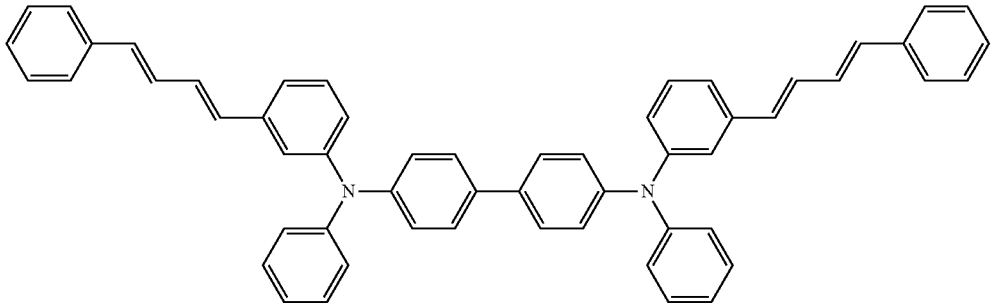

The binder resin as a component of the charge transporting layer includes a styrene resin, an acrylic resin, a polycarbonate resin, a polyester resin, and the like. The binder resin can also be a resin soluble in the first liquid. In particular, the binder resin can be a polycarbonate resin or a polyester resin. Furthermore, the binder resin can be a polycarbonate resin having a repeating structural unit represented by the following formula (2), or a polyester resin having a repeating structural unit represented by the following formula (3).

(2)

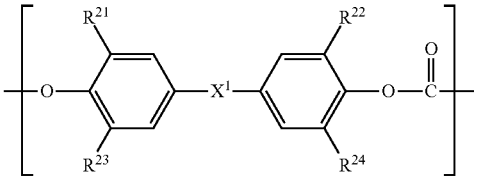

(In the formula (2), $R^{21}$ to $R^{24}$ each independently represent a hydrogen atom or a methyl group. $X^1$ represents a single bond, a methylene group, an ethylidene group, a propylidene group, a phenylethylidene group, a cyclohexylidene group, or an oxygen atom.)

(3)

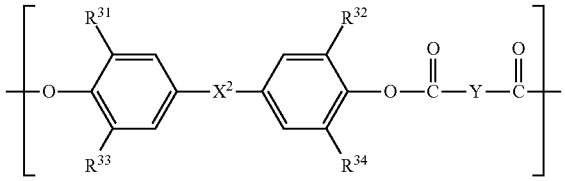

(In the formula (3), $R^{31}$ to $R^{34}$ each independently represent a hydrogen atom or a methyl group. $X^2$ represents a single bond, a methylene group, an ethylidene group, a propylidene group, a cyclohexylidene group, or an oxygen atom. Y represents a m-phenylene group, a p-phenylene group, or a divalent group where two p-phenylene groups are bound with an oxygen atom.)

Specific examples of the polycarbonate resin and the polyester resin include the following.

(2-1)

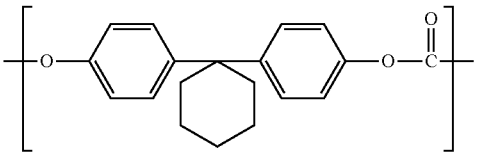

(2-2)

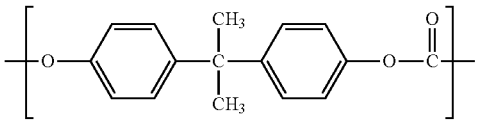

(2-3)

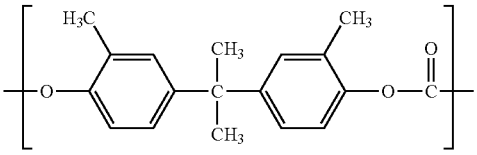

(2-4)

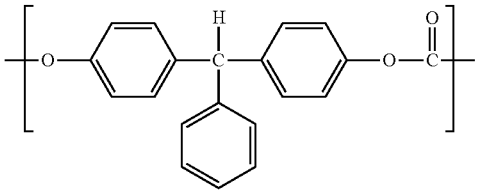

(2-5)

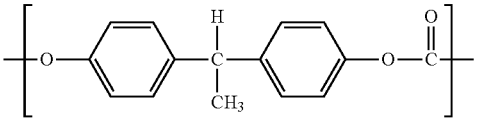

(2-6)

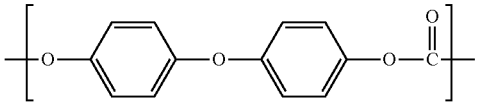

(2-7)

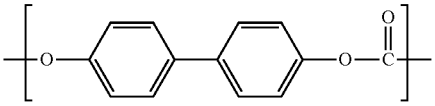

(2-8)

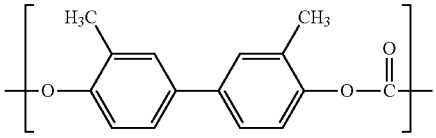

(3-1)

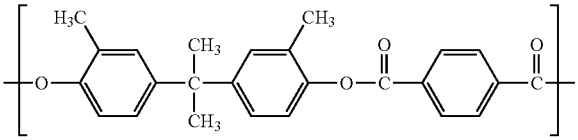

(3-2)

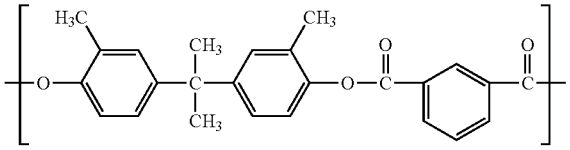

(3-3)

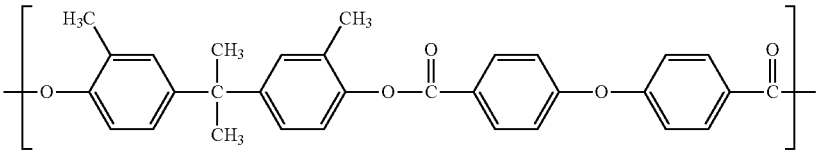

-continued (3-4)

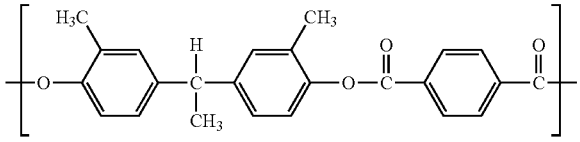

(3-5)

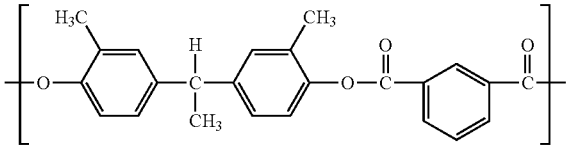

(3-6)

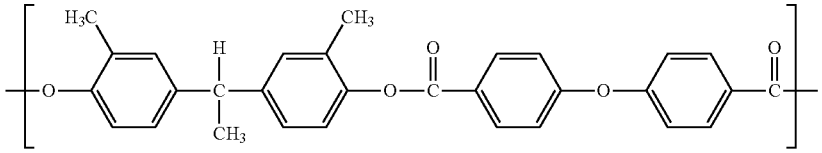

The weight average molecular weight of each resin described in the present invention corresponds to a weight average molecular weight on the polystyrene equivalent basis, measured according to an ordinary method, specifically the method described in Japanese Patent Application Laid-Open No. 2007-79555.

The charge transporting layer of an electrophotographic photosensitive member may contain an additive in addition to the charge transporting substance and the binder resin. Examples of the additive as a component of the charge transporting layer include antidegradation agents such as an antioxidant, an ultraviolet absorber and a light stabilizer, and a releasability-imparting resin. Examples of the antidegradation agent include a hindered phenol-based antioxidant, a hindered amine-based light stabilizer, a sulfur atom-containing antioxidant, and a phosphorous atom-containing antioxidant. Examples of the releasability-imparting resin include a fluorine atom-containing resin and a resin containing a siloxane structure.

In the method for producing an electrophotographic photosensitive member of the present invention, the charge transporting substance and the binder resin are dissolved in the first liquid to prepare the first solution. The first liquid has a solubility in water at 25° C. and 1 atm of 1.0 mass % or less. The first liquid having the above characteristics exhibits hydrophobicity. Specific examples of the first liquid are shown in Table 1, but are not limited to the examples in Table 1. Each solubility in water in Table 1 corresponds to the solubility in water at 25° C. and 1 atm (atmospheric pressure) of the first liquid, represented by mass %.

TABLE 1

| | First liquid | Solubility in water |
|---|---|---|
| First liquid example (1) | Toluene | 0.1 mass % |
| First liquid example (2) | Chloroform | 0.8 mass % |
| First liquid example (3) | o-Dichlorobenzene | 0.0 mass % |
| First liquid example (4) | Chlorobenzene | 0.1 mass % |
| First liquid example (5) | o-Xylene | 0.0 mass % |
| First liquid example (6) | Ethylbenzene | 0.0 mass % |
| First liquid example (7) | Phenetole | 0.1 mass % |

Among the above first liquids, a solvent having an aromatic ring structure is preferable from the viewpoint of the solubilities of the charge transporting substance and the binder resin, in particular, at least one selected from the group consisting of toluene, chloroform, dichlorobenzene, chlorobenzene, xylene, ethylbenzene and phenetole is preferable, and further, at least one of toluene and xylene is more preferable from the viewpoint of enhancement in stability of the emulsion. In addition, xylene can be o-xylene. Two or more of the above first liquids can be mixed and used.

The total mass of the charge transporting substance and the binder resin contained in the first solution can be 10 to 50 mass % based on the mass of the first solution in view of production because the viscosity of the first solution is appropriate. The ratio of the charge transporting substance to the binder resin in the first solution preferably ranges from 4:10 to 20:10 (mass ratio), and more preferably ranges from 5:10 to 12:10 (mass ratio). In order to achieve the above mixing ratio, the ratio of the charge transporting substance and the binder resin contained in the first solution is adjusted. In the case where the first solution contains the above additive, the proportion of such an additive is preferably 50 mass % or less and more preferably 30 mass % or less, based on the total solid content ratio of the charge transporting substance to the binder resin. The first solution may also contain a surfactant.

Then, the second solution will be described. The second solution contains a second liquid having a solubility in water at 25° C. and 1 atm of 5.0 mass % or more and a solubility in the first liquid at 25° C. and 1 atm of 5.0 mass % or more, and water. The second liquid is shown in Table 2. In Table 2, each solubility in water corresponds to the solubility in water at 25° C. and 1 atm (atmospheric pressure) of the second liquid represented by mass %, and each solubility in first liquid corresponds to the solubility in the first liquid at 25° C. and 1 atm (atmospheric pressure) of the second liquid represented by mass %.

TABLE 2

| | Second liquid | Solubility in water | Solubility in first liquid |
|---|---|---|---|
| Second liquid example (1) | tetrahydrofuran | 100.0 mass % or more | 5.0 mass % or more |
| Second liquid example (2) | dimethoxymethane | 32.3 mass % | 5.0 mass % or more |
| Second liquid example (3) | 1,2-dioxane | 100.0 mass % or more | 5.0 mass % or more |
| Second liquid example (4) | 1,3-dioxane | 100.0 mass % or more | 5.0 mass % or more |
| Second liquid example (5) | 1,4-dioxane | 100.0 mass % or more | 5.0 mass % or more |
| Second liquid example (6) | 1,3,5-trioxane | 21.1 mass % | 5.0 mass % or more |
| Second liquid example (7) | methanol | 100.0 mass % or more | 5.0 mass % or more |
| Second liquid example (8) | 2-pentanone | 5.9 mass % | 5.0 mass % or more |

TABLE 2-continued

| | Second liquid | Solubility in water | Solubility in first liquid |
|---|---|---|---|
| Second liquid example (9) | ethanol | 100.0 mass % or more | 5.0 mass % or more |
| Second liquid example (10) | tetrahydropyran | 100.0 mass % or more | 5.0 mass % or more |
| Second liquid example (11) | diethylene glycol dimethyl ether | 100.0 mass % or more | 5.0 mass % or more |
| Second liquid example (12) | ethylene glycol dimethyl ether | 100.0 mass % or more | 5.0 mass % or more |
| Second liquid example (13) | propylene glycol n-butyl ether | 6.0 mass % | 5.0 mass % or more |
| Second liquid example (14) | propylene glycol monopropyl ether | 100.0 mass % or more | 5.0 mass % or more |
| Second liquid example (15) | ethylene glycol monomethyl ether | 100.0 mass % or more | 5.0 mass % or more |
| Second liquid example (16) | diethylene glycol monoethyl ether | 100.0 mass % or more | 5.0 mass % or more |
| Second liquid example (17) | ethylene glycol monoisopropyl ether | 100.0 mass % or more | 5.0 mass % or more |
| Second liquid example (18) | ethylene glycol monobutyl ether | 100.0 mass % or more | 5.0 mass % or more |
| Second liquid example (19) | ethylene glycol monoisobutyl ether | 100.0 mass % or more | 5.0 mass % or more |
| Second liquid example (20) | ethylene glycol monoallyl ether | 100.0 mass % or more | 5.0 mass % or more |
| Second liquid example (21) | propylene glycol monomethyl ether | 100.0 mass % or more | 5.0 mass % or more |
| Second liquid example (22) | dipropylene glycol monomethyl ether | 100.0 mass % or more | 5.0 mass % or more |
| Second liquid example (23) | tripropylene glycol monomethyl ether | 100.0 mass % or more | 5.0 mass % or more |
| Second liquid example (24) | propylene glycol monobutyl ether | 6.4 mass % | 5.0 mass % or more |
| Second liquid example (25) | propylene glycol monomethyl ether acetate | 20.5 mass % | 5.0 mass % or more |
| Second liquid example (26) | diethylene glycol methyl ethyl ether | 100.0 mass % or more | 5.0 mass % or more |
| Second liquid example (27) | diethylene glycol diethyl ether | 100.0 mass % or more | 5.0 mass % or more |
| Second liquid example (28) | dipropylene glycol dimethyl ether | 37.0 mass % or more | 5.0 mass % or more |
| Second liquid example (29) | propylene glycol diacetate | 7.4 mass % or more | 5.0 mass % or more |
| Second liquid example (30) | methyl acetate | 19.6 mass % or more | 5.0 mass % or more |
| Second liquid example (31) | ethyl acetate | 8.3 mass % or more | 5.0 mass % or more |
| Second liquid example (32) | n-propyl alcohol | 100.0 mass % or more | 5.0 mass % or more |
| Second liquid example (33) | 3-methoxybutanol | 100.0 mass % or more | 5.0 mass % or more |
| Second liquid example (34) | 3-methoxybutyl acetate | 6.5 mass % or more | 5.0 mass % or more |
| Second liquid example (35) | ethylene glycol monomethyl ether acetate | 100.0 mass % or more | 5.0 mass % or more |

It is to be noted that each value of "Solubility in first liquid" in Table 2 corresponds to each value of solubility in the first liquid described in Table 1.

Among the above second liquids, a liquid having a solubility in water at 25° C. and 1 atm of 20.0 mass % or more can be used. Among the above second liquids, a solvent having an ether bond is preferable, in particular, at least one selected from the group consisting of tetrahydrofuran, dimethoxymethane, 1,2-dioxane, 1,3-dioxane, 1,4-dioxane, 1,3,5-trioxane, methanol, 2-pentanone, ethanol, tetrahydropyran, diethylene glycol dimethyl ether, ethylene glycol dimethyl ether, propylene glycol n-butyl ether, propylene glycol monopropyl ether, ethylene glycol monomethyl ether, diethylene glycol monoethyl ether, ethylene glycol monoisopropyl ether, ethylene glycol monobutyl ether, ethylene glycol monoisobutyl ether, ethylene glycol monoallyl ether, propylene glycol monomethyl ether, dipropylene glycol monomethyl ether, tripropylene glycol monomethyl ether, propylene glycol monobutyl ether, propylene glycol monomethyl ether acetate, diethylene glycol methyl ethyl ether, diethylene glycol diethyl ether, dipropylene glycol dimethyl ether, propylene glycol diacetate, methyl acetate, ethyl acetate, n-propyl alcohol, 3-methoxybutanol, 3-methoxybutyl acetate, and ethylene glycol monomethyl ether acetate is preferable, and further, tetrahydrofuran, propylene glycol monopropyl ether, and dimethoxymethane are more preferable from the viewpoint of stabilizing the emulsion. Two or more of the second liquids may also be mixed and used.

The ratio of the second liquid to water in the second solution can be as follows: mass of second liquid:mass of water=3/97 to 40/60.

The second solution may also contain a surfactant.

Then, the emulsion prepared from the first solution and the second solution will be described.

As an emulsifying method for preparing the emulsion, any existing emulsifying method can be used. The emulsion contains at least the charge transporting substance and the binder resin at least partially dissolved in emulsified particles. Hereinafter, a stirring method and a high pressure impingement method will be described as specific emulsifying methods, but the production method of the present invention is not limited to the methods.

The stirring method is described. The first solution is gradually added while the second solution being stirred by a stirring machine without being foamed. Water contained in the second solution can be ion exchange water from which a metal ion and the like have been removed by an ion exchange resin and the like, from the viewpoints of characteristics of an electrophotographic photosensitive member and an organic device thin film. The conductivity of ion exchange water can be 5 μS/cm or less. The stirring machine can be a stirring machine capable of stirring at a high speed from the viewpoint of capable of uniformly dispersing in a short time. The stirring machine includes a homogenizer (Physcotron) manufactured by Microtec Co., Ltd., and a circulation homogenizer (Clearmix) manufactured by M Technique Co., Ltd., and the like.

The emulsion can also be dispersed by an apparatus that allows a mixed liquid to impinge at a high pressure. Such a dispersing apparatus includes Microfluidizer M-110EH manufactured by Microfluidics Corporation, Nanomizer YSNM-2000AR manufactured by Yoshida Kikai Co., Ltd., and the like.

The emulsion may also be subjected to the above dispersing method at a high pressure after being treated by the above stirring method.

The mixing ratio of the first solution containing the first liquid, the charge transporting substance and the binder resin to the second solution containing the second liquid and water is as follows: mass of first solution/mass of second solution=5/5 to 2/8. The mixing ratio can be 5/5 to 3/7 from the viewpoint of maintaining the stability of the emulsion and at the same time obtaining an emulsion having a high solid content concentration.

The ratio (w/(a+c)) of the mass (w) of water to the total mass (a+c) of the first liquid and the second liquid in the emulsion can be 5/5 to 7/3 from the viewpoints of making the emulsified particles smaller in the case of being emulsified and enhancing the stability of the emulsion.

The ratio (a/c) of the mass (a) of the first liquid to the mass (c) of the second liquid in the emulsion can be 97/3 to 30/70. The above ratios are adjusted so that the charge transporting substance and the binder resin are dissolved in the first liquid, and thus can be adjusted within a proper range so that the particle size of the emulsified particles and the desired solid content concentration are achieved. The ratio of the charge transporting substance to the binder resin in the first solution can be within such a range that the charge transporting substance and the binder resin are dissolved and an appropriate viscosity is achieved at the time of emulsifying, from the viewpoint of preparing a stable emulsion. Specifically, the total contents of the charge transporting substance and the binder resin dissolved in the first solution can be within a range of 10 mass % or more and 50 mass % or less. The viscosity of the first solution with the charge transporting substance and the binder resin dissolved can be within a range of 50 mPa·s or more and 500 mPa·s or less.

The emulsion of the present invention may also contain a surfactant for the purpose of further stabilizing emulsifying. The surfactant can be a non-ionic surfactant from the viewpoint of suppressing deterioration of charge transport characteristics. The non-ionic surfactant is a surfactant whose hydrophilic site is non-electrolyte, namely, a surfactant having a hydrophilic portion not to be ionized. Examples of the non-ionic surfactant include the following:

Naroacty series, Emulmin series, Sannonic series and Newpol series manufactured by Sanyo Chemical Industries Ltd.;

Emulgen series, Rheodol series and Emanon series manufactured by Kao Corporation;

Adekatol series, Adekaestol series and Adekanol series manufactured by ADEKA Corporation; and non-ionic surfactant series among Newcol series manufactured by Nippon Nyukazai Co., Ltd.

One, or two or more of the above surfactants can be used singly, or can be used in combination. In addition, a surfactant having an HLB value (hydrophilic-lipophilic balance value) ranging from 8 to 15 can be selected for stabilizing the emulsion.

The amount of the surfactant added can be as small as possible from the viewpoint of not deteriorating charge transport characteristics, and the content of the surfactant in the emulsion preferably ranges from 0 mass % to 1.5 mass % and more preferably ranges from 0 mass % to 0.8 mass %. The surfactant may be contained in the second solution, or may be contained in the first solution. The surfactant may also be contained in both of the first solution and the second solution. The emulsion of the present invention may also contain additives such as a leveling agent, antifoaming agent, and a viscoelastic modifier as long as the effects of the present invention are not impaired. The additives are more effective when being soluble in water. The leveling agent is not limited irrespective of a structure as long as the leveling agent is a material that can give a leveling effect. Particularly, the leveling agent can be silicone-based or acrylic-based. The silicone-based leveling agent includes LS-430 manufactured by Kusunoki Chemicals Ltd., BYK-345, BYK-347 and BYK-348 manufactured by BYK Japan KK, and the like. The acrylic-based leveling agent includes AQ-7120 manufactured by Kusumoto Chemicals Ltd., BYK-340 manufactured by BYK Japan KK, and the like.

The average particle size of the emulsified particles in the emulsion preferably ranges from 0.1 to 20.0 μm and more preferably ranges from 0.1 to 5.0 μm, from the viewpoint of the stability of the emulsion.

Then, a method for forming a coat of the emulsion on the support will be described. For a method for applying the emulsion to form a coat, any existing method of a dip coating method, a ring coating method, a spray coating method, a spinner coating method, a roller coating method, a Mayer bar coating method, a blade coating method, and the like can be applied, and a dip coating method can be applied from the viewpoint of productivity. By any of the above methods, the emulsion of the present invention can be applied to form a coat on the support.

Then, a step of heating the coat to thereby form the charge transporting layer will be described. The formed coat is heated to thereby form the charge transporting layer on the support.

Since the emulsion at least containing the charge transporting substance and the binder resin is applied to form the coat in the present invention, the coat can be heated to remove a dispersing medium, and at the same time to allow the emulsified particles to adhere to one another and to allow a film to be more uniformly formed, from the viewpoint of forming a coat having a high uniformity. From the viewpoint of the uniformity of the film thickness, the particle size of the emulsified particles can be made smaller because the uniformity of the film thickness is rapidly made higher after the dispersing medium is removed. The heating temperature can be 100° C. or higher. The heating temperature can also be a temperature equal to or higher than the melting point of a charge transporting substance whose melting point is the lowest among charge transporting substances as components of the charge transporting layer, from the viewpoint of making the adhesiveness of the emulsified particles higher. The charge transporting substance is melted by heating at a temperature equal to or higher than the melting point of the charge transporting substance and thus the binder resin is dissolved in the melted charge transporting substance, thereby enabling forming a coat having a high uniformity. The heating temperature can also be a temperature higher than the melting point of a charge transporting substance whose melting point is the lowest among charge transporting substances as components of the charge transporting layer, by 5° C. or higher. If the heating temperature is too high, the charge transporting substance is caused to be modified and the like, and thus the heating temperature can be 200° C. or lower.

The film thickness of the charge transporting layer is preferably 5 μm or more and 50 μm or less, and more preferably 8 μm or more and 35 μm or less.

In the present invention, the second liquid soluble in the first liquid contained in the first solution is present in the second solution, thereby making the emulsified particles smaller. It is considered that the second liquid soluble in the first liquid is present in the second solution, thereby allowing the first liquid to be eluted from the first solution to the second solution during emulsifying, and that the volume of the emulsified particles containing the first solution is reduced, thereby making the emulsified particles smaller. It is considered that the emulsified particles are made smaller, thereby enabling the emulsified particles to be stably present in the emulsion, and preventing the emulsified particles from aggregating (coalescing). Therefore, the emulsion can be kept in the dispersion state even after being stored for a long period. In addition, if the emulsion in which the emulsified particles are made smaller is used as the coating liquid, a uniform charge transporting layer can be formed after film formation.

It is also considered that in the case where the boiling point of the second liquid is higher than the heating temperature, an effect as a film-forming aid for making the adhesiveness of the emulsified particles higher is also exerted.

Then, the method for producing an organic device which has a charge transporting layer according to the present invention will be described.

In the method for producing an organic device according to the present invention, the charge transporting substance is dissolved in the first liquid to prepare the first solution. The first liquid has a solubility in water at 25° C. and 1 atm of 1.0 mass % or less. The first liquid having such characteristics exhibits hydrophobicity. Specific examples of the first liquid are shown in Table 1, but are not limited to the examples in Table 1.

Among the above first liquids, a solvent having an aromatic ring structure is preferable from the viewpoint of the solubility of the charge transporting substance, and in particular, toluene and o-xylene are more preferable from the viewpoint of enhancement in stability of the emulsion. Two or more of the first liquids can be mixed and used.

The mass of the charge transporting substance contained in the first solution can be 10 to 50 mass % based on the mass of the first solution in view of production because the viscosity of the first solution is appropriate. The first solution may also contain a surfactant.

Then, the second solution in the method for producing an organic device which has a charge transporting layer according to the present invention will be described.

The second solution contains a second liquid having a solubility in water at 25° C. and 1 atm of 5.0 mass % or more and a solubility in the first liquid at 25° C. and 1 atm of 5.0 mass % or more, and water. The second liquid is shown in Table 2. Among the above second liquids, an ether-based solvent is preferable, and in particular, tetrahydrofuran and propylene glycol monopropyl ether are more preferable from the viewpoint of stabilizing the emulsion. Two or more of the second liquids may also be mixed and used. The ratio of the second liquid to water in the second solution can be as follows: mass of second liquid/mass of water=3/97 to 40/60. The second solution may also contain a surfactant.

Then, the emulsion prepared from the first solution and the second solution in the method for producing an organic device which has a charge transporting layer of the present invention will be described.

An emulsifying method for preparing the emulsion of the present invention is as described above.

The mixing ratio of the first solution containing the first liquid and the charge transporting substance to the second solution containing the second liquid and water is as follows: mass of first solution/mass of second solution=5/5 to 2/8. The mixing ratio can be 5/5 to 3/7 from the viewpoint of obtaining an emulsion having a high solid content concentration while the stability of the emulsion being maintained.

The ratio (w/(a+c)) of the mass (w) of water to the total mass (a+c) of the first liquid and the second liquid in the emulsion can be 5/5 to 7/3 from the viewpoints of making the size of oil drops smaller in the case of being emulsified and stabilizing the emulsion.

The ratio (a/c) of the mass (a) of the first liquid to the mass (c) of the second liquid in the emulsion can be 97/3 to 30/70. The above ratios are adjusted so that the charge transporting substance is dissolved in the first liquid, and thus can be adjusted within a proper range so that the desired particle size of the emulsified particles and the desired solid content concentration are achieved.

The emulsion of the present invention may also contain a surfactant for the purpose of further stabilizing emulsifying. The surfactant is as described above.

The amount of the surfactant added can be as small as possible from the viewpoint of not deteriorating charge transport characteristics, and the content of the surfactant in the emulsion preferably ranges from 0 mass % to 1.5 mass % and more preferably ranges from 0 mass % to 0.8 mass %. The surfactant may be contained in the second solution, or may be contained in the first solution. The surfactant may also be contained in both of the first solution and the second solution. The emulsion of the present invention may also contain additives such as a leveling agent, antifoaming agent, and a viscoelastic modifier as long as the effects of the present invention are not impaired.

The average particle size of the emulsified particles in the emulsion preferably ranges from 0.1 to 20.0 μm and more preferably ranges from 0.1 to 5.0 μm, from the viewpoint of the stability of the emulsion.

Then, a method for forming the coat of the emulsion on the support in the method for producing an organic device which has a charge transporting layer of the present invention will be described.

For a method for coating the emulsion to form the coat, any existing method of a spinner coating method, a roller coating method, a Mayer bar coating method, a blade coating method, and the like can be applied. By any of the above methods, the emulsion of the present invention can be applied to form the coat on the support.

Then, a step of heating the coat to thereby form the charge transporting layer will be described. The formed coat is heated to thereby form the charge transporting layer on the support.

Since the emulsion at least containing the charge transporting substance is applied to form the coat in the present invention, the coat can be heated to remove a dispersing medium, and at the same time to allow the emulsified particles to adhere to one another and to allow a film to be more uniformly formed, from the viewpoint of forming a coat having a high uniformity. From the viewpoint of the uniformity of the film thickness, the particle size of the emulsified particles can be made smaller because the uniformity of the film thickness is rapidly made higher after the dispersing medium is removed. The heating temperature can be 100° C. or higher.

Then, a configuration of an electrophotographic photosensitive member produced by the method for producing an electrophotographic photosensitive member according to the present invention will be described.

The method for producing an electrophotographic photosensitive member of the present invention is a method for producing an electrophotographic photosensitive member which has a support, and a charge generating layer and a charge transporting layer on the support.

While the electrophotographic photosensitive member generally widely used is a cylindrical electrophotographic photosensitive member with a photosensitive layer on a cylindrical support, the electrophotographic photosensitive member can also be a belt-shaped or sheet-shaped.

The support can be a support having conductivity (conductive support), and a support made of a metal such as aluminum, an aluminum alloy, or stainless can be used. In the case where the support is a support made of aluminum or an aluminum alloy, an ED tube, an EI tube, or a support obtained by subjecting such a tube to cutting, electrolytic composite polishing, or wet or dry honing treatment can also be used. In addition, a support made of a metal, having a layer in which a cover is formed by vacuum deposition of aluminum, an aluminum alloy or an indium oxide-tin oxide alloy, or a support made of a resin can also be used. In addition, a support in which a resin is impregnated with conductive particles such as carbon black, tin oxide particles, titanium oxide particles, or silver particles, or a plastic having a conductive resin can also be used.

The surface of the support may be subjected to a cutting treatment, a surface-roughening treatment, an alumite treatment, or the like.

A conductive layer may also be provided between the support and an intermediate layer or a charge generating layer described later. The conductive layer is a layer formed by using a coating liquid for a conductive layer, in which conductive particles are dispersed in a resin. Examples of the conductive particles include carbon black, acetylene black, powders of metals such as aluminum, nickel, iron, nichrome, copper, zinc and silver, and powders of metal oxides such as conductive tin oxide and ITO.

Examples of the resin include a polyester resin, a polycarbonate resin, polyvinyl butyral, an acrylic resin, a silicone resin, an epoxy resin, a melamine resin, a urethane resin, a phenol resin and an alkyd resin.

Examples of a solvent for the coating liquid for a conductive layer include an ether-based solvent, an alcohol-based solvent, a ketone-based solvent and an aromatic hydrocarbon solvent.

The film thickness of the conductive layer is preferably 0.2 μm or more and 40 μm or less, more preferably 1 μm or more and 35 μm or less, and further more preferably 5 μm or more and 30 μm or less.

An intermediate layer may also be provided between the support or the conductive layer and the charge generating layer.

The intermediate layer can be formed by coating the conductive layer with a coating liquid for an intermediate layer, containing a resin, and drying or curing the resultant.

Examples of the resin of the intermediate layer include polyacrylic acids, methylcellulose, ethylcellulose, a polyamide resin, a polyimide resin, a polyamide-imide resin, a polyamide acid resin, a melamine resin, an epoxy resin, a polyurethane resin and a polyolefin resin. The resin of the intermediate layer can be a thermoplastic resin. Specifically, the resin can be a thermoplastic polyamide resin or a polyolefin resin. The polyamide resin can be low crystalline or non-crystalline copolymerized nylon that can be applied in the state of a solution. The polyolefin resin can be usable as a particle dispersion. Furthermore, the polyolefin resin can be dispersed in an aqueous medium.

The film thickness of the intermediate layer is preferably 0.05 μm or more and 7 μm or less, and more preferably 0.1 μm or more and 2 μm or less.

The intermediate layer may also contain semiconductive particles, an electron transporting substance, or an electron acceptable substance.

A charge generating layer is provided on the support, the conductive layer or the intermediate layer.

Examples of a charge generating substance for use in the electrophotographic photosensitive member of the present invention include an azo pigment, a phthalocyanine pigment, an indigo pigment and a perylene pigment. One, or two or more of the charge generating substances may be used alone, or may be used in combination. Among the charge generating substances, in particular, the charge generating substance can be metal phthalocyanine such as oxytitanium phthalocyanine, hydroxygallium phthalocyanine or chlorogallium phthalocyanine because of having a high sensitivity.

Examples of a resin for use in the charge generating layer include a polycarbonate resin, a polyester resin, a butyral resin, a polyvinyl acetal resin, an acrylic resin, a vinyl acetate resin and a urea resin. Among the resins, in particular, the resin can be a butyral resin. One, or two or more of the resins can be used singly, or can be used as a mixture or a copolymer.

The charge generating layer can be formed by applying a coating liquid for a charge generating layer, obtained by dispersing the charge generating substance together with the resin and the solvent, and drying the resultant. The charge generating layer may also be a film with the charge generating substance deposited.

Examples of a dispersing method include a method using a homogenizer, an ultrasonic wave, a ball mill, a sand mill, an attritor or a roll mill.

The ratio of the charge generating substance to the resin preferably ranges from 1:10 to 10:1 (mass ratio), and particularly more preferably ranges from 1:1 to 3:1 (mass ratio).

A solvent for use in the coating liquid for a charge generating layer is selected depending on the solubilities and dispersing stabilities of the resin and the charge generating substance used. Examples of an organic solvent include an alcohol-based solvent, a sulfoxide-based solvent, a ketone-based solvent, an ether-based solvent, an ester-based solvent or an aromatic hydrocarbon solvent.

The film thickness of the charge generating layer is preferably 5 μm or less, and more preferably 0.1 μm or more and 2 μm or less.

In addition, various sensitizers, antioxidants, ultraviolet absorbers and plasticizers can also be added to the charge generating layer, if necessary. In order to allow the flow of charge not to interrupt in the charge generating layer, the charge generating layer may also contain an electron transporting substance or an electron acceptable substance.

The charge transporting layer is provided on the charge generating layer.

The charge transporting layer of the present invention is produced by the method described above.

Various additives can be added to the respective layers of the electrophotographic photosensitive member of the present invention. Examples of the additive include antidegradation agents such as an antioxidant, an ultraviolet absorber and a light stabilizer, and fine particles such as organic fine particles and inorganic fine particles. Examples of the antidegradation agent include a hindered phenol-based antioxidant, a hindered amine-based light stabilizer, a sulfur atom-containing antioxidant and a phosphorous atom-containing antioxidant. Examples of the organic fine particles include fluorine atom-containing resin particles, and polymer resin particles such as polystyrene fine particles and polyethylene resin particles. Examples of the inorganic fine particles include metal oxides such as silica and alumina.

In coating the respective coating liquids for the respective layers, any coating method such as a dip coating method, a spray coating method, a spinner coating method, a roller coating method, a Mayer bar coating method or a blade coating method can be used.

In addition, an unevenness shape (depressing shape, protruding shape) may also be formed on the surface of the surface layer of the electrophotographic photosensitive member. For a method for forming an unevenness shape, a known method can be employed. The forming method includes a method for forming a depressing shape by blowing abrasive particles on the surface, a method for forming an unevenness shape by bringing a mold having an asperity shape into contact with the surface under pressure, a method for forming a depressing shape by irradiating the surface with laser light, and the like. In particular, the forming method can be a method for forming an unevenness shape by bringing a mold having an unevenness shape into contact with the surface of the surface layer of the electrophotographic photosensitive member under pressure.

FIG. 1 illustrates one example of a schematic configuration of an electrophotographic apparatus provided with a process cartridge having an electrophotographic photosensitive member of the present invention.

In FIG. 1, reference number 1 denotes a cylindrical electrophotographic photosensitive member, and is rotatably driven around an axis 2 in an arrow direction at a predetermined peripheral velocity. The surface of the electrophotographic photosensitive member 1 to be rotatably driven is uniformly charged by a charging unit (primary charging unit: charge roller or the like) 3 at a predetermined positive or negative potential. Then, the surface receives exposing light (image exposing light) 4 output from an exposing unit (not illustrated) such as a slit exposing unit or a laser beam scanning exposing unit. Thus, an electrostatic latent image corresponding to the intended image is sequentially formed on the surface of the electrophotographic photosensitive member 1.

The electrostatic latent image formed on the surface of the electrophotographic photosensitive member 1 is developed by a toner contained in a developer of a developing unit 5, thereby being turned into a toner image. Then, the toner image formed and supported on the surface of the electrophotographic photosensitive member 1 is sequentially transferred to a transfer material (paper or the like) P by a transfer bias from a transferring unit (transfer roller or the like) 6. It is to be noted that the transfer material P is ejected in synchronization with the rotation of the electrophotographic photosensitive member 1 and fed from a transfer material-feeding unit (not illustrated) to a place (abutting portion) between the electrophotographic photosensitive member 1 and the transferring unit 6.

The transfer material P on which the toner image is transferred is separated from the surface of the electrophotographic photosensitive member 1, introduced into a fitting unit 8, subjected to image fixing, and thus printed out as an image-formed article (print, copy) to the outside of an apparatus.

The remaining developer (toner) is removed from the surface of the electrophotographic photosensitive member 1 after the toner image is transferred and the surface is cleaned by a cleaning unit (cleaning blade or the like) 7. Then, the surface is subjected to a neutralization treatment with pre-exposing light (not illustrated) from a pre-exposing unit (not illustrated), and then repeatedly used for forming an image. It is to be noted that as in illustrated in FIG. 1, in the case where the charging unit 3 is a contact charging unit using a charge roller or the like, pre-exposing is not necessarily needed.

A plurality of components among the electrophotographic photosensitive member 1, the charging unit 3, the developing unit 5, the transferring unit 6, the cleaning unit 7 and the like are accommodated in a container and configured to be bound integratedly with a process cartridge, and the process cartridge may also be configured to be mountable to or detachable from the main body of an electrophotographic apparatus such as a copier or a laser beam printer. In FIG. 1, the electrophotographic photosensitive member 1, the charging unit 3, the developing unit 5 and the cleaning unit 7 are integratedly supported to be formed into a cartridge, and a guiding unit 10 such as a rail of the main body of the electrophotographic apparatus is used to form a process cartridge 9 mountable to or detachable from the main body of the electrophotographic apparatus.

EXAMPLES

Hereinafter, the present invention will be described in more detail with reference to Examples and Comparative Examples. However, the present invention is not limited to the following Examples at all. It is to be noted that "part(s)" in the Examples means "part(s) by mass".

Example 1

Making of Emulsion

Six parts of a compound represented by the formula (1-1) as a charge transporting substance and 6 parts of a polycarbonate resin (weight average molecular weight Mw=20,000) having a repeating structure represented by the formula (2-1) as a binder resin were dissolved in 28 parts of toluene as a first liquid to prepare 40 parts of a first solution.

Then, 0.6 parts of Noigen EA-167 (produced by Dai-Ichi Kogyo Seiyaku Co., Ltd., HLB=14.8) and 6 parts of tetrahydrofuran as a second liquid were added to 53.4 parts of ion exchange water (conductivity: 0.2 μS/cm) and mixed to prepare 60 parts of a second solution.

The first solution was gradually added over 10 minutes while the second solution being stirred at 3,000 rpm/min by a homogenizer (Physcotron) manufactured by Microtec Co., Ltd. After the completion of the dropwise addition, the rotation number of the homogenizer was raised to 5,000 rpm/min and the resultant was stirred for 10 minutes. Thereafter, the resultant was dispersed by a high pressure impingement dispersing machine, Nanomizer (manufactured by Yoshida Kikai Co., Ltd.) under a pressure condition of 150 MPa to yield an emulsion (100 parts). The types and contents of the charge transporting substance, binder resin, first liquid, water, second liquid and surfactant used are shown in Table 3. The average particle size of the resulting emulsion was 4.34 μm.

(Evaluation of Liquid Stability of Emulsion)

After making an emulsion by the above method, the emulsion was visually evaluated and the particle size of the emulsified particles was evaluated. The prepared emulsion was left to stand for 2 weeks (under an environment of a temperature of 23° C. and a humidity of 50%). The emulsion left to stand was stirred at 1,000 rpm/min for 3 minutes by using a homogenizer (Physcotron) manufactured by Microtec Co., Ltd. Herein, the emulsion was visually evaluated before and after being left to stand, in the state where the emulsion was diluted with water by 2-fold and then charged in a cell measuring 1 cm×1 cm.

The state of the emulsion after stirring was visually observed. The average particle sizes of the emulsified particles in the emulsion before being left to stand and after being left to stand and being stirred were measured by a laser diffraction/scattering particle size distribution measuring apparatus LA-950 manufactured by Horiba Ltd. The results are shown in Table 4. Each particle size in Table 4 represents the average particle size of the emulsified particles. Herein, the solubility in the first liquid example (1) used in Example 1 at 25° C. and 1 atm of the second liquid example (1) was 100 mass % or more.

Examples 2 to 65 and 166 to 168

The same manner as in Example 1 was used, and each charge transporting substance, binder resin, first liquid, water, second liquid and surfactant were changed as shown in Table 3. The evaluation results of the liquid stability of each of the resulting emulsions are shown in Table 4. In Example 25, 5 parts of (1-1) as a charge transporting substance and 1 part of (1-6) were used. Herein, the solubility in the first liquid example (1) used in each of Examples 2 to 7 at 25° C. and 1 atm of the second liquid example (1) was 100 mass % or more. The solubility in the first liquid example (1) used in each of Examples 8 to 10 at 25° C. and 1 atm of the second liquid example (2) was 100 mass % or more. The solubility in the first liquid example (1) used in each of Examples 13 and 14 at 25° C. and 1 atm of the second liquid example (5) was 100 mass % or more. The solubility in the first liquid example (1) used in each of Examples 15 to 18 at 25° C. and 1 atm of the second liquid example (14) was 100 mass % or more. The solubility in the first liquid example (1) used in Example 20 at 25° C. and 1 atm of the second liquid example (7) was 100 mass % or more. The solubility in the first liquid example (1) used in Example 21 at 25° C. and 1 atm of the second liquid example (9) was 100 mass % or more. The solubility in the first liquid example (4) used in each of Examples 32 and 33 at 25° C. and 1 atm of the second liquid example (1) was 100 mass % or more. The solubility in the first liquid example (4) used in Example 34 at 25° C. and 1 atm of the second liquid example (2) was 100 mass % or more. The solubility in the first liquid example (7) used in Example 166 at 25° C. and 1 atm of the second liquid example (1) was 100 mass % or more. The solubility in the first liquid example (7) used in Example 167 at 25° C. and 1 atm of the second liquid example (2) was 100 mass % or more. The solubility in the first liquid example (7) used in Example 168 at 25° C. and 1 atm of the second liquid example (5) was 100 mass % or more.

Comparative Example 1

A coating liquid containing a charge transporting substance and a binder resin was made based on the method described in PTL 1.

The coating liquid containing a charge transporting substance and a binder resin was made according to the following method.

Six parts of a compound represented by the formula (1-4) as a charge transporting substance and 6 parts of a polycarbonate resin (Mw=20,000) having a repeating structure represented by the formula (2-1) as a binder resin were dissolved in 28 parts of toluene as an organic solvent to make 40 parts of an organic solution for a charge transporting layer. Then, 0.6 parts of Noigen EA-167 was added to 59.4 parts of water to make an aqueous solution.

The organic solution was gradually added over 10 minutes while the aqueous solution being stirred at 3,000 rpm/min by a homogenizer (Physcotron) manufactured by Microtec Co., Ltd., and after the completion of the dropwise addition, the rotation number of the homogenizer was raised to 5,000 rpm/min and the resultant was stirred for 10 minutes to yield an emulsion for a charge transporting layer (100 parts). Materials contained in the coating liquid and the contents of the materials are shown in Table 3.

The same evaluation as in Example 1 was performed. The results are shown in Table 4. Separation and aggregation were observed even after the stirring by the homogenizer, separation in diluting water for measurement was remarkably observed, and the particle size could not be measured.

Comparative Examples 2 to 4

Each coating liquid was made by the same manner as in Comparative Example 1, and each emulsion for a charge transporting layer was attempted to be prepared. Materials contained in the coating liquid and the contents of the materials are shown in Table 3.

After the preparation, the same evaluation as in Example 1 was performed. The results are shown in Table 4. Separation and aggregation were observed even after the stirring by the homogenizer, separation in diluting water for measurement was remarkably observed, and the particle size could not be measured.

Comparative Examples 5 to 11

Each coating liquid was made in the same manner as in Example 1 except that each of liquid (1) to liquid (6) shown below was used as the second liquid and the content of each liquid was as shown in Table 3, and each emulsion for a charge transporting layer was attempted to be made. Materials contained in the coating liquid and the contents of the materials are shown in Table 3.

Liquid (1) used in Comparative Example 5: dipropylene glycol monobutyl ether (solubility in water at 25° C. and 1 atm (atmospheric pressure) of liquid (1):3.0 mass %; solubility in first solution at 25° C. and 1 atm (atmospheric pressure) of liquid (1):5.0 mass % or more)

Liquid (2) used in Comparative Example 6: diethylene glycol monophenyl ether (solubility in water at 25° C. and 1 atm (atmospheric pressure) of liquid (2):3.4 mass %; solubility in first solution at 25° C. and 1 atm (atmospheric pressure) of liquid (2):5.0 mass % or more)

Liquid (3) used in Comparative Example 7: diethylene glycol monohexyl ether (solubility in water at 25° C. and 1 atm (atmospheric pressure) of liquid (3):1.7 mass %; solubility in first solution at 25° C. and 1 atm (atmospheric pressure) of liquid (3):5.0 mass % or more)

Liquid (4) used in Comparative Examples 8 and 9: isopropyl acetate (solubility in water at 25° C. and 1 atm (atmospheric pressure) of liquid (4):2.9 mass %; solubility in first solution at 25° C. and 1 atm (atmospheric pressure) of liquid (4):5.0 mass % or more)

Liquid (5) used in Comparative Example 10: tripropylene glycol n-butyl ether (solubility in water at 25° C. and 1 atm (atmospheric pressure) of liquid (5):2.9 mass %; solubility in first solution at 25° C. and 1 atm (atmospheric pressure) of liquid (5):5.0 mass % or more)

Liquid (6) used in Comparative Example 11: 1,4-butanediol diacetate (solubility in water at 25° C. and 1 atm (atmospheric pressure) of liquid (6):4.2 mass %; solubility in first solution at 25° C. and 1 atm (atmospheric pressure) of liquid (6):5.0 mass % or more)

After the preparation, the same evaluation as in Example 1 was performed. The results are shown in Table 4. Separation, aggregation and gelation were observed even after the stirring by the homogenizer, separation in diluting water for measurement was remarkably observed, and the particle size could not be measured.

TABLE 3

| | First liquid | Charge transporting substance | Binder resin | Second liquid | First liquid | Charge transporting substance | Binder resin | Water | Second liquid | Surfactant |
|---|---|---|---|---|---|---|---|---|---|---|
| Example 1 | First liquid example (1) | 1-1 | 2-1 | Second liquid example (1) | 28.0 | 6.0 | 6.0 | 57.0 | 2.4 | 0.6 |

TABLE 3-continued

| | First liquid | Charge transporting substance | Binder resin | Second liquid | First liquid | Charge transporting substance | Binder resin | Water | Second liquid | Surfac-tant |
|---|---|---|---|---|---|---|---|---|---|---|
| Example 2 | First liquid example (1) | 1-1 | 2-1 | Second liquid example (1) | 28.0 | 6.0 | 6.0 | 53.4 | 6.0 | 0.6 |
| Example 3 | First liquid example (1) | 1-1 | 2-1 | Second liquid example (1) | 28.0 | 6.0 | 6.0 | 50.4 | 9.0 | 0.6 |
| Example 4 | First liquid example (1) | 1-1 | 2-1 | Second liquid example (1) | 28.0 | 6.0 | 6.0 | 50.7 | 9.0 | 0.3 |
| Example 5 | First liquid example (1) | 1-1 | 2-1 | Second liquid example (1) | 28.0 | 6.0 | 6.0 | 47.4 | 12.0 | 0.6 |
| Example 6 | First liquid example (1) | 1-1 | 2-1 | Second liquid example (1) | 28.0 | 6.0 | 6.0 | 41.4 | 18.0 | 0.6 |
| Example 7 | First liquid example (1) | 1-1 | 2-1 | Second liquid example (1) | 28.0 | 6.0 | 6.0 | 35.4 | 24.0 | 0.6 |
| Example 8 | First liquid example (1) | 1-1 | 2-1 | Second liquid example (2) | 28.0 | 6.0 | 6.0 | 57.0 | 2.4 | 0.6 |
| Example 9 | First liquid example (1) | 1-1 | 2-1 | Second liquid example (2) | 28.0 | 6.0 | 6.0 | 53.4 | 6.0 | 0.6 |
| Example 10 | First liquid example (1) | 1-1 | 2-1 | Second liquid example (2) | 28.0 | 6.0 | 6.0 | 50.4 | 9.0 | 0.6 |
| Example 11 | First liquid example (1) | 1-1 | 2-1 | Second liquid example (11) | 28.0 | 6.0 | 6.0 | 57.0 | 2.4 | 0.6 |
| Example 12 | First liquid example (1) | 1-1 | 2-1 | Second liquid example (11) | 28.0 | 6.0 | 6.0 | 53.4 | 6.0 | 0.6 |
| Example 13 | First liquid example (1) | 1-1 | 2-1 | Second liquid example (5) | 28.0 | 6.0 | 6.0 | 57.0 | 2.4 | 0.6 |
| Example 14 | First liquid example (1) | 1-1 | 2-1 | Second liquid example (5) | 28.0 | 6.0 | 6.0 | 53.4 | 6.0 | 0.6 |
| Example 15 | First liquid example (1) | 1-1 | 2-1 | Second liquid example (14) | 28.0 | 6.0 | 6.0 | 57.0 | 2.4 | 0.6 |
| Example 16 | First liquid example (1) | 1-1 | 2-1 | Second liquid example (14) | 28.0 | 6.0 | 6.0 | 53.4 | 6.0 | 0.6 |
| Example 17 | First liquid example (1) | 1-1 | 2-1 | Second liquid example (14) | 28.0 | 6.0 | 6.0 | 50.4 | 9.0 | 0.6 |
| Example 18 | First liquid example (1) | 1-1 | 2-1 | Second liquid example (14) | 28.0 | 6.0 | 6.0 | 47.4 | 12.0 | 0.6 |
| Example 19 | First liquid example (1) | 1-1 | 2-1 | Second liquid example (13) | 28.0 | 6.0 | 6.0 | 57.6 | 1.8 | 0.6 |
| Example 20 | First liquid example (1) | 1-1 | 2-1 | Second liquid example (7) | 28.0 | 6.0 | 6.0 | 53.4 | 6.0 | 0.6 |
| Example 21 | First liquid example (1) | 1-1 | 2-1 | Second liquid example (9) | 28.0 | 6.0 | 6.0 | 53.4 | 6.0 | 0.6 |
| Example 22 | First liquid example (1) | 1-1 | 3-1 | Second liquid example (1) | 34.0 | 3.0 | 3.0 | 53.4 | 6.0 | 0.6 |
| Example 23 | First liquid example (1) | 1-6 | 3-1 | Second liquid example (1) | 32.0 | 4.0 | 4.0 | 53.4 | 6.0 | 0.6 |
| Example 24 | First liquid example (1) | 1-2 | 2-1 | Second liquid example (1) | 28.0 | 6.0 | 6.0 | 53.4 | 6.0 | 0.6 |
| Example 25 | First liquid example (1) | 1-1, 1-6 | 2-1 | Second liquid example (1) | 28.0 | 6.0 | 6.0 | 53.4 | 6.0 | 0.6 |
| Example 26 | First liquid example (1) | 1-1 | 2-1 | Second liquid example (1) | 30.0 | 5.0 | 5.0 | 50.0 | 9.5 | 0.5 |
| Example 27 | First liquid example (1) | 1-1 | 2-1 | Second liquid example (1) | 27.0 | 2.7 | 2.7 | 70.0 | 3.4 | 0.8 |
| Example 28 | First liquid example (5) | 1-1 | 2-1 | Second liquid example (1) | 28.0 | 6.0 | 6.0 | 53.4 | 6.0 | 0.6 |
| Example 29 | First liquid example (5) | 1-1 | 3-1 | Second liquid example (1) | 34.0 | 3.0 | 3.0 | 53.4 | 6.0 | 0.6 |
| Example 30 | First liquid example (5) | 1-1 | 3-1 | Second liquid example (5) | 32.0 | 4.0 | 4.0 | 53.4 | 6.0 | 0.6 |
| Example 31 | First liquid example (5) | 1-6 | 2-1 | Second liquid example (1) | 28.0 | 6.0 | 6.0 | 53.4 | 6.0 | 0.6 |
| Example 32 | First liquid example (4) | 1-1 | 2-1 | Second liquid example (1) | 28.0 | 6.0 | 6.0 | 53.4 | 6.0 | 0.6 |
| Example 33 | First liquid example (4) | 1-6 | 3-1 | Second liquid example (1) | 34.0 | 3.0 | 3.0 | 53.4 | 6.0 | 0.6 |
| Example 34 | First liquid example (4) | 1-1 | 3-1 | Second liquid example (2) | 32.0 | 4.0 | 4.0 | 53.4 | 6.0 | 0.6 |
| Example 35 | First liquid example (4) | 1-6 | 3-1 | Second liquid example (1) | 34.0 | 3.0 | 3.0 | 53.4 | 6.0 | 0.6 |
| Example 36 | First liquid example (2) | 1-1 | 2-1 | Second liquid example (11) | 28.0 | 6.0 | 6.0 | 53.4 | 6.0 | 0.6 |
| Example 37 | First liquid example (1) | 1-2 | 2-1 | Second liquid example (4) | 30.0 | 5.0 | 5.0 | 50.0 | 9.5 | 0.5 |
| Example 38 | First liquid example (1) | 1-2 | 2-1 | Second liquid example (1) | 50.0 | 6.0 | 6.5 | 50.0 | 3.0 | 0.5 |
| Example 39 | First liquid example (1) | 1-2 | 2-1 | Second liquid example (3) | 27.0 | 4.5 | 4.5 | 80.0 | 6.0 | 0.8 |

TABLE 3-continued

| | First liquid | Charge transporting substance | Binder resin | Second liquid | First liquid | Charge transporting substance | Binder resin | Water | Second liquid | Surfac-tant |
|---|---|---|---|---|---|---|---|---|---|---|
| Example 40 | First liquid example (1) | 1-1 | 2-1 | Second liquid example (6) | 28.0 | 6.0 | 6.0 | 53.4 | 6.0 | 0.6 |
| Example 41 | First liquid example (1) | 1-1 | 2-1 | Second liquid example (8) | 28.0 | 6.0 | 6.0 | 53.4 | 6.0 | 0.6 |
| Example 42 | First liquid example (1) | 1-1 | 2-1 | Second liquid example (10) | 28.0 | 6.0 | 6.0 | 53.4 | 6.0 | 0.6 |
| Example 43 | First liquid example (1) | 1-1 | 2-1 | Second liquid example (12) | 28.0 | 6.0 | 6.0 | 53.4 | 6.0 | 0.6 |
| Example 44 | First liquid example (5) | 1-1 | 2-1 | Second liquid example (15) | 28.0 | 6.0 | 6.0 | 53.4 | 6.0 | 0.6 |
| Example 45 | First liquid example (5) | 1-1 | 2-1 | Second liquid example (16) | 28.0 | 6.0 | 6.0 | 53.4 | 6.0 | 0.6 |
| Example 46 | First liquid example (5) | 1-1 | 2-1 | Second liquid example (17) | 28.0 | 6.0 | 6.0 | 53.4 | 6.0 | 0.6 |
| Example 47 | First liquid example (5) | 1-1 | 2-1 | Second liquid example (18) | 28.0 | 6.0 | 6.0 | 53.4 | 6.0 | 0.6 |
| Example 48 | First liquid example (5) | 1-1 | 2-1 | Second liquid example (19) | 28.0 | 6.0 | 6.0 | 53.4 | 6.0 | 0.6 |
| Example 49 | First liquid example (5) | 1-1 | 2-1 | Second liquid example (20) | 28.0 | 6.0 | 6.0 | 53.4 | 6.0 | 0.6 |
| Example 50 | First liquid example (5) | 1-1 | 2-1 | Second liquid example (21) | 28.0 | 6.0 | 6.0 | 53.4 | 6.0 | 0.6 |
| Example 51 | First liquid example (5) | 1-1 | 2-1 | Second liquid example (22) | 28.0 | 6.0 | 6.0 | 53.4 | 6.0 | 0.6 |
| Example 52 | First liquid example (5) | 1-1 | 2-1 | Second liquid example (23) | 28.0 | 6.0 | 6.0 | 53.4 | 6.0 | 0.6 |
| Example 53 | First liquid example (5) | 1-1 | 2-1 | Second liquid example (14) | 32.0 | 4.0 | 4.0 | 53.4 | 6.0 | 0.6 |
| Example 54 | First liquid example (5) | 1-1 | 2-1 | Second liquid example (24) | 28.0 | 6.0 | 6.0 | 53.4 | 6.0 | 0.6 |
| Example 55 | First liquid example (5) | 1-1 | 2-1 | Second liquid example (25) | 28.0 | 6.0 | 6.0 | 53.4 | 6.0 | 0.6 |
| Example 56 | First liquid example (5) | 1-1 | 2-1 | Second liquid example (26) | 28.0 | 6.0 | 6.0 | 53.4 | 6.0 | 0.6 |
| Example 57 | First liquid example (5) | 1-1 | 2-1 | Second liquid example (27) | 28.0 | 6.0 | 6.0 | 53.4 | 6.0 | 0.6 |
| Example 58 | First liquid example (5) | 1-1 | 2-1 | Second liquid example (28) | 28.0 | 6.0 | 6.0 | 53.4 | 6.0 | 0.6 |
| Example 59 | First liquid example (5) | 1-1 | 2-1 | Second liquid example (29) | 28.0 | 6.0 | 6.0 | 53.4 | 6.0 | 0.6 |
| Example 60 | First liquid example (5) | 1-1 | 2-1 | Second liquid example (30) | 28.0 | 6.0 | 6.0 | 53.4 | 6.0 | 0.6 |
| Example 61 | First liquid example (5) | 1-1 | 2-1 | Second liquid example (31) | 28.0 | 6.0 | 6.0 | 53.4 | 6.0 | 0.6 |
| Example 62 | First liquid example (5) | 1-1 | 2-1 | Second liquid example (32) | 28.0 | 6.0 | 6.0 | 53.4 | 6.0 | 0.6 |
| Example 63 | First liquid example (5) | 1-1 | 2-1 | Second liquid example (33) | 28.0 | 6.0 | 6.0 | 53.4 | 6.0 | 0.6 |
| Example 64 | First liquid example (5) | 1-1 | 2-1 | Second liquid example (34) | 28.0 | 6.0 | 6.0 | 53.4 | 6.0 | 0.6 |
| Example 65 | First liquid example (5) | 1-1 | 2-1 | Second liquid example (35) | 28.0 | 6.0 | 6.0 | 53.4 | 6.0 | 0.6 |
| Comparative Example 1 | First liquid example (1) | 1-2 | 2-1 | — | 28.0 | 6.0 | 6.0 | 59.4 | 0.0 | 0.6 |
| Comparative Example 2 | First liquid example (4) | 1-1 | 2-1 | — | 28.0 | 6.0 | 6.0 | 59.4 | 0.0 | 0.6 |
| Comparative Example 3 | First liquid example (2) | 1-1 | 2-1 | — | 28.0 | 6.0 | 6.0 | 59.4 | 0.0 | 0.6 |
| Comparative Example 4 | First liquid example (1) | 1-2 | 2-1 | — | 40.0 | 5.0 | 5.0 | 49.5 | 0.0 | 0.5 |
| Comparative Example 5 | First liquid example (1) | 1-2 | 2-1 | Liquid (1) | 28.0 | 6.0 | 6.0 | 53.4 | 6.0 | 0.6 |
| Comparative Example 6 | First liquid example (1) | 1-2 | 2-1 | Liquid (2) | 28.0 | 6.0 | 6.0 | 53.4 | 6.0 | 0.6 |
| Comparative Example 7 | First liquid example (1) | 1-2 | 2-1 | Liquid (3) | 28.0 | 6.0 | 6.0 | 53.4 | 6.0 | 0.6 |
| Comparative Example 8 | First liquid example (1) | 1-1 | 2-1 | Liquid (4) | 28.0 | 6.0 | 6.0 | 57.9 | 1.5 | 0.6 |
| Comparative Example 9 | First liquid example (1) | 1-1 | 2-1 | Liquid (4) | 28.0 | 6.0 | 6.0 | 53.4 | 6.0 | 0.6 |
| Comparative Example 10 | First liquid example (1) | 1-1 | 2-1 | Liquid (5) | 28.0 | 6.0 | 6.0 | 57.9 | 1.5 | 0.6 |
| Comparative Example 11 | First liquid example (4) | 1-2 | 2-1 | Liquid (6) | 28.0 | 6.0 | 6.0 | 57.4 | 2.0 | 0.6 |
| Example 166 | First liquid example (7) | 1-1 | 2-1 | Second liquid example (1) | 28.0 | 6.0 | 6.0 | 53.4 | 6.0 | 0.6 |

TABLE 3-continued

| | First liquid | Charge transporting substance | Binder resin | Second liquid | First liquid | Charge transporting substance | Binder resin | Water | Second liquid | Surfac-tant |
|---|---|---|---|---|---|---|---|---|---|---|
| Example 167 | First liquid example (7) | 1-1 | 2-1 | Second liquid example (2) | 28.0 | 6.0 | 6.0 | 53.4 | 6.0 | 0.6 |
| Example 168 | First liquid example (7) | 1-1 | 2-1 | Second liquid example (5) | 32.0 | 4.0 | 4.0 | 57.0 | 2.4 | 0.6 |

TABLE 4

| | Just after preparation | | After left to stand for 2 weeks | | |
|---|---|---|---|---|---|
| | Visual observation | Particle size (μm) | Visual observation | Visual observation after stirring by homogenizer | Particle size after stirring by homogenizer (μm) |
| Example 1 | Uniform | 4.34 | Precipitate | Uniform | 4.36 |
| Example 2 | Uniform | 3.25 | Precipitate | Uniform | 3.28 |
| Example 3 | Uniform | 3.10 | Precipitate | Uniform | 3.12 |
| Example 4 | Uniform | 4.50 | Precipitate | Uniform | 7.30 |
| Example 5 | Uniform | 2.90 | Precipitate | Uniform | 2.96 |
| Example 6 | Uniform | 2.60 | Precipitate | Uniform | 2.82 |
| Example 7 | Uniform | 2.53 | Precipitate | Uniform | 2.61 |
| Example 8 | Uniform | 4.40 | Precipitate | Uniform | 4.40 |
| Example 9 | Uniform | 3.31 | Precipitate | Uniform | 3.33 |
| Example 10 | Uniform | 2.80 | Precipitate | Uniform | 3.01 |
| Example 11 | Uniform | 4.12 | Precipitate | Uniform | 4.40 |
| Example 12 | Uniform | 3.06 | Separation into 2 layers | Uniform | 4.50 |
| Example 13 | Uniform | 3.91 | Separation into 2 layers | Uniform | 3.95 |
| Example 14 | Uniform | 3.03 | Separation into 2 layers | Uniform | 3.51 |
| Example 15 | Uniform | 3.58 | Precipitate | Uniform | 3.59 |
| Example 16 | Uniform | 2.95 | Precipitate | Uniform | 2.99 |
| Example 17 | Uniform | 2.55 | Precipitate | Uniform | 2.60 |
| Example 18 | Uniform | 2.30 | Precipitate | Uniform | 2.36 |
| Example 19 | Uniform | 5.17 | Separation into 2 layers | Uniform | 5.30 |
| Example 20 | Uniform | 3.67 | Separation into 2 layers | Uniform | 3.67 |
| Example 21 | Uniform | 3.70 | Separation into 2 layers | Uniform | 3.77 |
| Example 22 | Uniform | 4.63 | Separation into 2 layers | Uniform | 4.65 |
| Example 23 | Uniform | 4.64 | Separation into 2 layers | Uniform | 4.66 |
| Example 24 | Uniform | 4.51 | Precipitate | Uniform | 4.58 |
| Example 25 | Uniform | 4.40 | Precipitate | Uniform | 4.43 |
| Example 26 | Uniform | 4.52 | Precipitate | Uniform | 4.55 |
| Example 27 | Uniform | 4.63 | Precipitate | Uniform | 4.63 |
| Example 28 | Uniform | 4.61 | Separation into 2 layers | Uniform | 4.41 |
| Example 29 | Uniform | 4.53 | Separation into 2 layers | Uniform | 4.42 |
| Example 30 | Uniform | 4.70 | Separation into 2 layers | Uniform | 4.80 |
| Example 31 | Uniform | 4.68 | Separation into 2 layers | Uniform | 4.71 |
| Example 32 | Uniform | 4.50 | Precipitate | Uniform | 4.58 |
| Example 33 | Uniform | 4.42 | Separation into 2 layers | Uniform | 4.44 |
| Example 34 | Uniform | 4.30 | Separation into 2 layers | Uniform | 4.60 |
| Example 35 | Uniform | 4.50 | Separation into 2 layers | Uniform | 4.62 |
| Example 36 | Uniform | 4.60 | Separation into 2 layers | Uniform | 4.63 |
| Example 37 | Uniform | 2.62 | Separation into 2 layers | Uniform | 5.62 |
| Example 38 | Uniform | 4.95 | Separation into 2 layers | Uniform | 5.66 |
| Example 39 | Uniform | 4.90 | Precipitate | Uniform | 5.73 |
| Example 40 | Uniform | 5.08 | Precipitate | Uniform | 5.65 |
| Example 41 | Uniform | 5.32 | Precipitate | Uniform | 5.81 |

TABLE 4-continued

| | Just after preparation | | After left to stand for 2 weeks | | |
|---|---|---|---|---|---|
| | Visual observation | Particle size (μm) | Visual observation | Visual observation after stirring by homogenizer | Particle size after stirring by homogenizer (μm) |
| Example 42 | Uniform | 4.51 | Precipitate | Uniform | 4.97 |
| Example 43 | Uniform | 4.55 | Precipitate | Uniform | 4.87 |
| Example 44 | Uniform | 4.44 | Precipitate | Uniform | 4.84 |
| Example 45 | Uniform | 4.51 | Precipitate | Uniform | 4.97 |
| Example 46 | Uniform | 4.62 | Precipitate | Uniform | 5.01 |
| Example 47 | Uniform | 4.72 | Precipitate | Uniform | 5.11 |
| Example 48 | Uniform | 4.65 | Precipitate | Uniform | 4.93 |
| Example 49 | Uniform | 4.63 | Precipitate | Uniform | 4.55 |
| Example 50 | Uniform | 4.52 | Precipitate | Uniform | 4.98 |
| Example 51 | Uniform | 4.31 | Precipitate | Uniform | 4.87 |
| Example 52 | Uniform | 4.47 | Precipitate | Uniform | 4.75 |
| Example 53 | Uniform | 4.65 | Precipitate | Uniform | 5.04 |
| Example 54 | Uniform | 5.28 | Precipitate | Uniform | 5.67 |
| Example 55 | Uniform | 5.01 | Precipitate | Uniform | 5.43 |
| Example 56 | Uniform | 4.65 | Precipitate | Uniform | 5.11 |
| Example 57 | Uniform | 4.58 | Precipitate | Uniform | 5.06 |
| Example 58 | Uniform | 4.77 | Precipitate | Uniform | 5.11 |
| Example 59 | Uniform | 5.14 | Precipitate | Uniform | 5.64 |
| Example 60 | Uniform | 4.68 | Precipitate | Uniform | 4.99 |
| Example 61 | Uniform | 5.02 | Precipitate | Uniform | 5.39 |
| Example 62 | Uniform | 4.65 | Precipitate | Uniform | 4.89 |
| Example 63 | Uniform | 4.58 | Precipitate | Uniform | 4.87 |
| Example 64 | Uniform | 5.11 | Precipitate | Uniform | 5.54 |
| Example 65 | Uniform | 4.44 | Precipitate | Uniform | 4.87 |
| Comparative Example 1 | Uniform | 5.25 | Separation into 2 layers | Separation into 2 layers | Unmeasurable |
| Comparative Example 2 | Uniform | 5.23 | Separation into 2 layers | Separation into 2 layers | Unmeasurable |
| Comparative Example 3 | Uniform | 5.28 | Separation into 2 layers | Separation into 2 layers | Unmeasurable |
| Comparative Example 4 | Uniform | 5.40 | Separation into 2 layers | Separation into 2 layers | Unmeasurable |
| Comparative Example 5 | Gelation | Unmeasurable | Still gel | Still gel | Unmeasurable |
| Comparative Example 6 | Gelation | Unmeasurable | Still gel | Still gel | Unmeasurable |
| Comparative Example 7 | Gelation | Unmeasurable | Still gel | Still gel | Unmeasurable |
| Comparative Example 8 | Uniform | 5.30 | Separation into 2 layers | Separation into 2 layers | Unmeasurable |
| Comparative Example 9 | Gelation | Unmeasurable | Still gel | Still gel | Unmeasurable |
| Comparative Example 10 | Uniform | 5.25 | Separation into 2 layers | Separation into 2 layers | Unmeasurable |
| Comparative Example 11 | Uniform | 5.20 | Separation into 2 layers | Separation into 2 layers | Unmeasurable |
| Example 166 | Uniform | 2.50 | Precipitate | Uniform | 2.52 |
| Example 167 | Uniform | 2.60 | Precipitate | Uniform | 2.80 |
| Example 168 | Uniform | 3.80 | Precipitate | Uniform | 3.95 |

It has been found that in the production method of the present invention, the particle size of the emulsified particles is maintained even in the coating liquid after left to stand and the emulsion is stable. Such finding indicates that the emulsion prepared from the second solution containing the second liquid of the present invention is better in practical usability than the emulsion containing no second liquid in that the emulsion of the present invention can be restored to the uniform dispersion state similar to the initial dispersion state by simple re-dispersing. The reason for such finding is considered that the second liquid soluble in the first liquid is present in the second solution as a component of the emulsion of the present invention, thereby allowing the first liquid to be eluted from the first solution to the second solution during emulsifying, and that the volume of the emulsified particles containing the first solution is reduced, thereby making the emulsified particles smaller. It is considered that the emulsified particles are made smaller, thereby enabling the emulsified particles to be stably present in the emulsion, and preventing the emulsified particles from aggregating (coalescing). Therefore, the emulsion can be kept in the dispersion state even after being stored for a long period.

On the other hand, with respect to the state after the emulsified coating liquid for a charge transporting layer based on the method described in PTL 1, obtained in Comparative Example 1, was left to stand, the sedimentation of oil drops was observed and some of oil drops coalesced and formed an aggregate on the bottom. The emulsified coating liquid for a charge transporting layer after the stirring was different from the emulsion just after preparing the coating liquid, an aggregate of oil drops was confirmed, and a coating liquid having a high uniformity could not be formed.

Examples 66 to 130 and 169 to 171

(1) Preparation of Coating Liquid for Conductive Layer

Ten parts of $SnO_2$-coated barium sulfate (conductive particles), 2 parts of titanium oxide (pigment for regulating resistance), 6 parts of a phenol resin, 0.001 parts of silicone oil (leveling agent), and a mixed solvent of 4 parts of methanol and 16 parts of methoxypropanol were used to prepare a coating liquid for a conductive layer.

(2) Preparation of Coating Liquid for Intermediate Layer

Then, 3 parts of N-methoxymethylated nylon and 3 parts of copolymerized nylon were dissolved in a mixed solvent of 65 parts of methanol and 30 parts of n-butanol to prepare a coating liquid for an intermediate layer.

(3) Preparation of Coating Liquid for Charge Generating Layer

Then, 10 parts of a crystalline hydroxygallium phthalocyanine (charge generating substance) having strong peaks at Bragg angles (2θ±0.2°) of 7.5°, 9.9°, 16.3°, 18.6°, 25.1° and 28.3° in CuKα characteristic X-ray diffraction was prepared. The phthalocyanine was mixed with 250 parts of cyclohexanone and 5 parts of polyvinyl butyral (trade name: S-lec BX-1, produced by Sekisui Chemical Co., Ltd.), and dispersed therein by a sand mill apparatus using glass beads having a diameter of 1 mm under an atmosphere of 23±3° C. for 1 hour. After the dispersing, 250 parts of ethyl acetate was added to prepare a coating liquid for a charge generating layer.

<Production of Electrophotographic Photosensitive Member>

An aluminum cylinder having a diameter of 24 mm and a length of 257 mm was dip coated with the coating liquid for a conductive layer prepared in (1) Preparation of Coating Liquid, and the resultant was heated at 140° C. for 30 minutes to form a conductive layer having a film thickness of 15 μm.

Then, the conductive layer was dip coated with the coating liquid for an intermediate layer prepared in (2) Preparation of Coating Liquid, and the resultant was heated at 100° C. for 10 minutes to form an intermediate layer having a film thickness of 0.7 μm.

Then, the intermediate layer was dip coated with the coating liquid for a charge generating layer prepared in (3) Preparation of Coating Liquid, and the resultant was heated at 100° C. for 10 minutes to form a charge generating layer having a film thickness of 0.26 μm.

Then, each of the emulsions prepared in Examples 1 to 65 and 166 to 168 was left to stand for 2 weeks (temperature: 23° C., humidity: 50%), then stirred at 1,000 rpm/min for 3 minutes using a homogenizer and then the charge generating layer was dip coated therewith, and the resultant was heated at 150° C. for 1 hour to form a charge transporting layer having a film thickness of 10 μm, thereby producing an electrophotographic photosensitive member.

<Uniformity Evaluation of Coat Surface>

The surface at a position apart from the upper end of the electrophotographic photosensitive member by 130 mm was measured by a surface roughness measuring instrument (Surfcorder SE-3400, manufactured by Kosaka Laboratory Ltd.), and subjected to a ten point average roughness (Rzjis) evaluation according to JIS B 0601:2001 (evaluation length: 10 mm). The results are shown in Table 5.

<Image Evaluation>

Image evaluation was performed using a laser beam printer LBP-2510 manufactured by Canon Inc. During the evaluation, the printer altered so that with respect to an exposure amount (image exposure amount) from a 780 nm laser source, the light intensity on the surface of the electrophotographic photosensitive member was 0.3 μJ/cm$^2$ was used. The evaluation was performed under an environment of a temperature of 23° C. and a humidity of 15%. With respect to the image evaluation, A4-size plain paper was used to output a monochrome halftone image and the output image was visually evaluated according to the following criteria.

Rank A: Uniform image over the entire face

Rank B: Slight image unevenness on a small part

Rank C: Image unevenness

Rank D: Remarkable image unevenness

The results are shown in Table 5.

Comparative Examples 12 to 22

Each of the coating liquids made in Comparative Examples 1 to 11 was used to make and evaluate an electrophotographic photosensitive member in the same manner as in Example 66. The results are shown in Table 5.

TABLE 5

| | Emulsion | Uniformity evaluation | Image evaluation |
|---|---|---|---|
| Example 66 | Example 1 | 0.55 | A |
| Example 67 | Example 2 | 0.50 | A |
| Example 68 | Example 3 | 0.49 | A |
| Example 69 | Example 4 | 0.48 | A |
| Example 70 | Example 5 | 0.49 | A |
| Example 71 | Example 6 | 0.50 | A |
| Example 72 | Example 7 | 0.51 | A |
| Example 73 | Example 8 | 0.50 | A |
| Example 74 | Example 9 | 0.52 | A |
| Example 75 | Example 10 | 0.51 | A |
| Example 76 | Example 11 | 0.52 | A |
| Example 77 | Example 12 | 0.50 | A |
| Example 78 | Example 13 | 0.49 | A |
| Example 79 | Example 14 | 0.50 | A |
| Example 80 | Example 15 | 0.51 | A |
| Example 81 | Example 16 | 0.53 | A |
| Example 82 | Example 17 | 0.49 | A |
| Example 83 | Example 18 | 0.51 | A |
| Example 84 | Example 19 | 0.49 | A |
| Example 85 | Example 20 | 0.50 | A |
| Example 86 | Example 21 | 0.51 | A |
| Example 87 | Example 22 | 0.49 | A |
| Example 88 | Example 23 | 0.50 | A |
| Example 89 | Example 24 | 0.51 | A |
| Example 90 | Example 25 | 0.50 | A |
| Example 91 | Example 26 | 0.49 | A |
| Example 92 | Example 27 | 0.53 | A |
| Example 93 | Example 28 | 0.50 | A |
| Example 94 | Example 29 | 0.49 | A |
| Example 95 | Example 30 | 0.52 | A |
| Example 96 | Example 31 | 0.51 | A |
| Example 97 | Example 32 | 0.51 | A |
| Example 98 | Example 33 | 0.51 | A |
| Example 99 | Example 34 | 0.50 | A |
| Example 100 | Example 35 | 0.49 | A |
| Example 101 | Example 36 | 0.53 | A |
| Example 102 | Example 37 | 0.69 | B |
| Example 103 | Example 38 | 0.65 | B |
| Example 104 | Example 39 | 0.60 | B |
| Example 105 | Example 40 | 0.61 | B |
| Example 106 | Example 41 | 0.63 | B |
| Example 107 | Example 42 | 0.51 | A |
| Example 108 | Example 43 | 0.49 | A |
| Example 109 | Example 44 | 0.50 | A |
| Example 110 | Example 45 | 0.51 | A |
| Example 111 | Example 46 | 0.53 | A |
| Example 112 | Example 47 | 0.53 | A |
| Example 113 | Example 48 | 0.54 | A |
| Example 114 | Example 49 | 0.49 | A |
| Example 115 | Example 50 | 0.50 | A |
| Example 116 | Example 51 | 0.51 | A |
| Example 117 | Example 52 | 0.53 | A |
| Example 118 | Example 53 | 0.51 | A |
| Example 119 | Example 54 | 0.64 | B |
| Example 120 | Example 55 | 0.63 | B |
| Example 121 | Example 56 | 0.52 | A |

TABLE 5-continued

| | Emulsion | Uniformity evaluation | Image evaluation |
|---|---|---|---|
| Example 122 | Example 57 | 0.53 | A |
| Example 123 | Example 58 | 0.55 | A |
| Example 124 | Example 59 | 0.66 | B |
| Example 125 | Example 60 | 0.51 | A |
| Example 126 | Example 61 | 0.64 | B |
| Example 127 | Example 62 | 0.50 | A |
| Example 128 | Example 63 | 0.52 | A |
| Example 129 | Example 64 | 0.62 | B |
| Example 130 | Example 65 | 0.54 | A |
| Comparative Example 12 | Comparative Example 1 | 0.80 | C |
| Comparative Example 13 | Comparative Example 2 | 0.75 | C |
| Comparative Example 14 | Comparative Example 3 | 0.72 | C |
| Comparative Example 15 | Comparative Example 4 | 0.85 | C |
| Comparative Example 16 | Comparative Example 5 | 2.80 | D |
| Comparative Example 17 | Comparative Example 6 | 2.54 | D |
| Comparative Example 18 | Comparative Example 7 | 3.01 | D |
| Comparative Example 19 | Comparative Example 8 | 0.80 | C |
| Comparative Example 20 | Comparative Example 9 | 2.10 | D |
| Comparative Example 21 | Comparative Example 10 | 0.80 | C |
| Comparative Example 22 | Comparative Example 11 | 0.79 | C |
| Example 169 | Example 166 | 0.48 | A |
| Example 170 | Example 167 | 0.48 | A |
| Example 171 | Example 168 | 0.51 | A |

In comparison Examples 66 to 130 and 169 to 171 with Comparative Examples 12 to 22, it has been found that the coat of the emulsion prepared from the second solution containing the second liquid of the present invention has a better uniformity than the coat of the emulsion containing no second liquid, in the case where each emulsion after being left to stand for a long time was used to be formed into a film. The reason for such finding is considered that the second liquid soluble in the first liquid is present in the second solution as a component of the emulsion of the present invention, thereby enabling the emulsified particles to be stably present in the emulsion. On the other hand, with respect to each of the emulsions in Comparative Example 1 to 11, it is considered that oil drops form a coalescence and an aggregate during being left to stand for a long time and the uniform dispersibility of oil drops is impaired, thereby deteriorating the uniformity on the surface of the coat after the coat formation as in Comparative Examples 12 to 22.

Example 131

As an organic device, an organic electroluminescence element was made as follows.

ITO having a film thickness of 100 nm was formed on a glass substrate as a support by a sputtering method. The resultant was subjected to ultrasonic wave washing with acetone and isopropyl alcohol (IPA) sequentially, and then washed with boiling IPA and dried. Furthermore, the surface of the substrate was subjected to UV/ozone washing, to be formed into an anode layer. Two parts of a compound (1-5) as a charge transporting substance was dissolved in 18 parts of toluene to make 20 parts of a first solution.

Then, 0.4 parts of Naroacty CL-85 (manufactured by Sanyo Chemical Industries Ltd., HLB=12.6) and 8 parts of tetrahydrofuran were added to 71.6 parts of ion exchange water (conductivity: 0.2 μS/cm) and mixed to make 80 parts of a second solution.

The first solution was gradually added over 10 minutes while the second solution being stirred at 3,000 rpm/min by a homogenizer (Physcotron) manufactured by Microtec Co., Ltd., and after the completion of the dropwise addition, the rotation number of the homogenizer was raised to 5,000 rpm/min and the resultant was stirred for 10 minutes. Thereafter, the resultant was dispersed by a high pressure impingement dispersing machine, Nanomizer (manufactured by Yoshida Kikai Co., Ltd.) under a pressure condition of 150 MPa to yield an emulsion for a charge transporting layer (100 parts).

The anode layer was spin coated with the emulsion for a charge transporting layer at 3,000 rpm/min for 30 seconds to form a film so that the film thickness was 50 nm, thereby forming a charge transporting layer.

Then, $Alq_3$ (tris(8-quinolinolato)aluminum) was vapor deposited to form a light-emitting layer having a film thickness of 25 nm.

Then, bathophenanthroline and cesium carbonate were codeposited so that the cesium concentration in a layer was 8.3 mass %, to form an electron injecting layer having a film thickness of 15 nm, and a film of silver (Ag) was formed on the layer by a heating vapor deposition to form a cathode layer having a film thickness of 12 nm.

The above method was used to make an organic electroluminescence element as an organic device. A voltage of 6 V was applied between the anode layer and the cathode layer, and it was confirmed that light is emitted at 8,000 Cd/cm$^2$. The results are shown in Table 6.

Example 132

An organic electroluminescence element was made in the same manner as in Example 131 except that the charge transporting substance was changed from the compound (1-5) to NPB(N,N-di(naphthalene-1-yl)-N,N-diphenylbenzidine) was used.

A voltage of 6 V was applied between the anode layer and the cathode layer, and it was confirmed that light is emitted at 9,000 Cd/cm$^2$. The results are shown in Table 6.

Examples 133 to 165 and 172 to 174

An organic electroluminescence element was made in the same manner as in Example 131 except that materials shown in Table 6 were used for the emulsion for a charge transporting layer. The same evaluation as in Example 131 was performed. The results are shown in Table 6.

TABLE 6

| | First liquid | Charge transporting substance | Second liquid | First liquid | Charge transporting substance | Water | Second liquid | Surfactant | Emission intensity (cd/cm$^2$) |
|---|---|---|---|---|---|---|---|---|---|
| Example 131 | First liquid example (1) | 1-5 | Second liquid example (1) | 18.0 | 2.0 | 71.6 | 8.0 | 0.4 | 8,000 |

TABLE 6-continued

| | First liquid | Charge transporting substance | Second liquid | First liquid | Charge transporting substance | Water | Second liquid | Surfac-tant | Emission intensity (cd/cm$^2$) |
|---|---|---|---|---|---|---|---|---|---|
| Example 132 | First liquid example (1) | NPB | Second liquid example (1) | 18.0 | 2.0 | 71.6 | 8.0 | 0.4 | 9,000 |
| Example 133 | First liquid example (1) | 1-5 | Second liquid example (2) | 18.0 | 2.0 | 71.6 | 8.0 | 0.4 | 7,500 |
| Example 134 | First liquid example (1) | 1-5 | Second liquid example (3) | 18.0 | 2.0 | 71.6 | 8.0 | 0.4 | 7,500 |
| Example 135 | First liquid example (1) | 1-5 | Second liquid example (4) | 18.0 | 2.0 | 71.6 | 8.0 | 0.4 | 7,300 |
| Example 136 | First liquid example (1) | 1-5 | Second liquid example (5) | 18.0 | 2.0 | 71.6 | 8.0 | 0.4 | 7,800 |
| Example 137 | First liquid example (1) | 1-5 | Second liquid example (6) | 18.0 | 2.0 | 71.6 | 8.0 | 0.4 | 7,000 |
| Example 138 | First liquid example (1) | 1-5 | Second liquid example (7) | 18.0 | 2.0 | 71.6 | 8.0 | 0.4 | 7,500 |
| Example 139 | First liquid example (1) | 1-5 | Second liquid example (8) | 18.0 | 2.0 | 71.6 | 8.0 | 0.4 | 7,500 |
| Example 140 | First liquid example (1) | 1-5 | Second liquid example (9) | 18.0 | 2.0 | 71.6 | 8.0 | 0.4 | 7,800 |
| Example 141 | First liquid example (1) | 1-5 | Second liquid example (10) | 18.0 | 2.0 | 71.6 | 8.0 | 0.4 | 7,800 |
| Example 142 | First liquid example (1) | 1-5 | Second liquid example (11) | 18.0 | 2.0 | 71.6 | 8.0 | 0.4 | 8,000 |
| Example 143 | First liquid example (1) | 1-5 | Second liquid example (12) | 18.0 | 2.0 | 71.6 | 8.0 | 0.4 | 7,800 |
| Example 144 | First liquid example (1) | 1-5 | Second liquid example (13) | 18.0 | 2.0 | 71.6 | 8.0 | 0.4 | 7,500 |
| Example 145 | First liquid example (1) | 1-5 | Second liquid example (14) | 18.0 | 2.0 | 71.6 | 8.0 | 0.4 | 7,500 |
| Example 146 | First liquid example (1) | 1-5 | Second liquid example (15) | 18.0 | 2.0 | 71.6 | 8.0 | 0.4 | 7,500 |
| Example 147 | First liquid example (1) | 1-5 | Second liquid example (16) | 18.0 | 2.0 | 71.6 | 8.0 | 0.4 | 7,800 |
| Example 148 | First liquid example (1) | 1-5 | Second liquid example (17) | 18.0 | 2.0 | 71.6 | 8.0 | 0.4 | 8,000 |
| Example 149 | First liquid example (1) | 1-5 | Second liquid example (18) | 18.0 | 2.0 | 71.6 | 8.0 | 0.4 | 7,800 |
| Example 150 | First liquid example (1) | 1-5 | Second liquid example (19) | 18.0 | 2.0 | 71.6 | 8.0 | 0.4 | 7,500 |
| Example 151 | First liquid example (1) | 1-5 | Second liquid example (20) | 18.0 | 2.0 | 71.6 | 8.0 | 0.4 | 7,800 |
| Example 152 | First liquid example (1) | 1-5 | Second liquid example (21) | 18.0 | 2.0 | 71.6 | 8.0 | 0.4 | 7,500 |
| Example 153 | First liquid example (1) | 1-5 | Second liquid example (22) | 18.0 | 2.0 | 71.6 | 8.0 | 0.4 | 7,500 |
| Example 154 | First liquid example (1) | 1-5 | Second liquid example (23) | 18.0 | 2.0 | 71.6 | 8.0 | 0.4 | 7,500 |
| Example 155 | First liquid example (1) | 1-5 | Second liquid example (24) | 18.0 | 2.0 | 71.6 | 8.0 | 0.4 | 7,800 |
| Example 156 | First liquid example (1) | 1-5 | Second liquid example (25) | 18.0 | 2.0 | 71.6 | 8.0 | 0.4 | 7,500 |
| Example 157 | First liquid example (1) | 1-5 | Second liquid example (26) | 18.0 | 2.0 | 71.6 | 8.0 | 0.4 | 7,500 |
| Example 158 | First liquid example (5) | 1-5 | Second liquid example (27) | 18.0 | 2.0 | 71.6 | 8.0 | 0.4 | 7,500 |
| Example 159 | First liquid example (5) | 1-5 | Second liquid example (28) | 18.0 | 2.0 | 71.6 | 8.0 | 0.4 | 7,500 |
| Example 160 | First liquid example (5) | 1-5 | Second liquid example (29) | 18.0 | 2.0 | 71.6 | 8.0 | 0.4 | 7,800 |
| Example 161 | First liquid example (5) | 1-5 | Second liquid example (30) | 18.0 | 2.0 | 71.6 | 8.0 | 0.4 | 7,500 |
| Example 162 | First liquid example (4) | 1-5 | Second liquid example (31) | 18.0 | 2.0 | 71.6 | 8.0 | 0.4 | 7,800 |
| Example 163 | First liquid example (4) | 1-5 | Second liquid example (32) | 18.0 | 2.0 | 71.6 | 8.0 | 0.4 | 7,500 |
| Example 164 | First liquid example (4) | 1-5 | Second liquid example (33) | 18.0 | 2.0 | 71.6 | 8.0 | 0.4 | 7,500 |
| Example 165 | First liquid example (4) | 1-5 | Second liquid example (34) | 18.0 | 2.0 | 71.6 | 8.0 | 0.4 | 7,800 |
| Example 172 | First liquid example (7) | 1-5 | Second liquid example (1) | 18.0 | 2.0 | 71.6 | 8.0 | 0.4 | 9,000 |
| Example 173 | First liquid example (7) | 1-5 | Second liquid example (2) | 18.0 | 2.0 | 71.6 | 8.0 | 0.4 | 9,000 |
| Example 174 | First liquid example (7) | 1-5 | Second liquid example (5) | 18.0 | 2.0 | 71.6 | 8.0 | 0.4 | 8,000 |

It has been confirmed from the results of Examples 131 to 165 and 172 to 174 that an organic electroluminescence element is produced as an organic device and has a good charge transporting function.

In the production method of the present invention, the second solution contains the second liquid and thus the first liquid in the first solution rapidly transfers into the second liquid in the step of preparing an emulsion. Such a phenomenon makes the particle size of the emulsified particles smaller and also raises the concentration of the charge transporting substance contained in the emulsified particles, thereby enabling considerably preventing an aggregate of the emulsified particles from being generated as compared with the case where the emulsion containing no second liquid is prepared. Therefore, the production method of the present invention is useful as a method for producing an organic device which has a film having a charge transporting function.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-282086, filed Dec. 22, 2011, and Japanese Patent Application No. 2012-255351, filed Nov. 21, 2012 which are hereby incorporated by reference herein in their entirety.

The invention claimed is:

1. A method of producing an electrophotographic photosensitive member which comprises a support and a charge transporting layer thereon, comprising the steps of:

preparing a first solution comprising:

a first liquid having a solubility in water at 25° C. and 1 atm of 1.0 mass % or less, a charge transporting substance, and a binder resin, preparing a second solution comprising:

a second liquid having a solubility in water at 25° C. and 1 atm of 5.0 mass % or more and a solubility in the first liquid at 25° C. and 1 atm of 5.0 mass % or more, and water, dispersing the first solution in the second solution to prepare an emulsion, forming a coat of the emulsion, and heating the coat to form the charge transporting layer.

2. A method of producing an electrophotographic photosensitive member according to claim 1, wherein the binder resin is a binder resin soluble in the first liquid.

3. A method of producing an electrophotographic photosensitive member according to claim 1, wherein the second liquid is a liquid having a solubility in water at 25° C. and 1 atm of 20.0 mass % or more.

4. A method of producing an electrophotographic photosensitive member according to claim 1, wherein the ratio (w/(a+c)) is 5/5 to 7/3, wherein w represents the mass of the water in the emulsion, a represents the mass of the first liquid in the emulsion, and c represents the mass of the second liquid in the emulsion.

5. A method of producing an electrophotographic photosensitive member according to claim 1, wherein the ratio (a/c) is 97/3 to 30/70, wherein a represents the mass of the first liquid in the emulsion, and c represents the mass of the second liquid in the emulsion.

6. A method of producing an electrophotographic photosensitive member according to claim 1, wherein the first liquid is at least one selected from the group consisting of toluene, chloroform, dichlorobenzene, chlorobenzene, xylene, ethylbenzene, and phenetole.

7. A method of producing an electrophotographic photosensitive member according to claim 6, wherein the first liquid is at least one selected from the group consisting of toluene and xylene.

8. A method of producing an electrophotographic photosensitive member according to claim 1, wherein the second liquid is at least one selected from the group consisting of tetrahydrofuran, dimethoxymethane, 1,2-dioxane, 1,3-dioxane, 1,4-dioxane, 1,3,5-trioxane, methanol, 2-pentanone, ethanol, tetrahydropyran, diethylene glycol dimethyl ether, ethylene glycol dimethyl ether, propylene glycol n-butyl ether, propylene glycol monopropyl ether, ethylene glycol monomethyl ether, diethylene glycol monoethyl ether, ethylene glycol monoisopropyl ether, ethylene glycol monobutyl ether, ethylene glycol monoisobutyl ether, ethylene glycol monoallyl ether, propylene glycol monomethyl ether, dipropylene glycol monomethyl ether, tripropylene glycol monomethyl ether, propylene glycol monobutyl ether, propylene glycol monomethyl ether acetate, diethylene glycol methyl ethyl ether, diethylene glycol diethyl ether, dipropylene glycol dimethyl ether, propylene glycol diacetate, methyl acetate, ethyl acetate, n-propyl alcohol, 3-methoxybutanol, 3-methoxybutyl acetate, and ethylene glycol monomethyl ether acetate.

9. A method of producing an electrophotographic photosensitive member according to claim 8, wherein the second liquid is at least one selected from the group consisting of tetrahydrofuran and dimethoxymethane.

10. A method of producing an electrophotographic photosensitive member according to claim 1, wherein the emulsion contains emulsified particles having an average particle size of from 0.1 μm to 5.0 μm.

11. A method of producing an organic device which comprises a charge transporting layer, comprising the steps of:

preparing a first solution comprising:

a first liquid having a solubility in water at 25° C. and 1 atm of 1.0 mass % or less, a charge transporting substance, and a binder resin, preparing a second solution comprising:

a second liquid having a solubility in water at 25° C. and 1 atm of 5.0 mass % or more and a solubility in the first liquid at 25° C. and 1 atm of 5.0 mass % or more, and water, dispersing the first solution in the second solution to prepare an emulsion, forming a coat of the emulsion, and heating the coat to form the charge transporting layer.

12. A method of producing an organic device according to claim 11, wherein the first liquid is at least one selected from the group consisting of toluene, chloroform, dichlorobenzene, chlorobenzene, xylene, ethylbenzene, and phenetole.

13. A method of producing an organic device according to claim 11, wherein the second liquid is at least one selected from the group consisting of tetrahydrofuran, dimethoxymethane, 1,2-dioxane, 1,3-dioxane, 1,4-dioxane, 1,3,5-trioxane, methanol, 2-pentanone, ethanol, tetrahydropyran, diethylene glycol dimethyl ether, ethylene glycol dimethyl ether, propylene glycol n-butyl ether, propylene glycol monopropyl ether, ethylene glycol monomethyl ether, diethylene glycol monoethyl ether, ethylene glycol monoisopropyl ether, ethylene glycol monobutyl ether, ethylene glycol monoisobutyl ether, ethylene glycol monoallyl ether, propylene glycol monomethyl ether, dipropylene glycol monomethyl ether, tripropylene glycol monomethyl ether, propylene glycol monobutyl ether, propylene glycol monomethyl ether acetate, diethylene glycol methyl ethyl ether, diethylene glycol diethyl ether, dipropylene glycol dimethyl ether, propylene glycol diacetate, methyl acetate, ethyl acetate, n-propyl alcohol, 3-methoxybutanol, 3-methoxybutyl acetate, and ethylene glycol monomethyl ether acetate.

14. A method of producing an electrophotographic photosensitive member which comprises a support and a charge transporting layer formed thereon, comprising the steps of:

preparing a first solution comprising:

a first liquid, a charge transporting substance, and a binder resin, preparing a second solution comprising:

a second liquid, and water, dispersing the first solution in the second solution to prepare an emulsion, forming a coat of the emulsion, and heating the coat to form the charge transporting layer, and wherein the first liquid is at least one selected from the group consisting of toluene, chloroform, dichlorobenzene, chlorobenzene, xylene, ethylbenzene, and phenetole, and the second liquid is at least one selected from the group consisting of tetrahydrofuran, dimethoxymethane, 1,2-dioxane, 1,3-dioxane, 1,4-dioxane, 1,3,5-trioxane, methanol, 2-pentanone, ethanol, tetrahydropyran, diethylene glycol dimethyl ether, ethylene glycol dimethyl ether, propylene glycol n-butyl ether, propylene glycol monopropyl ether, ethylene glycol monomethyl ether, diethylene glycol monoethyl ether, ethylene glycol monoisopropyl ether, ethylene glycol monobutyl ether, ethylene glycol monoisobutyl ether, ethylene glycol monoallyl ether, propylene glycol monomethyl ether, dipropylene glycol monomethyl ether, tripropylene glycol monomethyl ether, propylene glycol monobutyl ether, propylene glycol monomethyl ether acetate, diethylene glycol methyl ethyl ether, diethylene glycol diethyl ether, dipropylene glycol dimethyl ether, propylene glycol diacetate, methyl acetate, ethyl acetate, n-propyl alcohol, 3-methoxybutanol, 3-methoxybutyl acetate, and ethylene glycol monomethyl ether acetate.

15. A method of producing an electrophotographic photosensitive member according to claim 1, wherein at least one selected from the first solution and the second solution contains a surfactant.

16. A method of producing an electrophotographic photosensitive member according to claim 15, wherein the content of the surfactant in the emulsion is from 0 mass % to 1.5 mass %.

* * * * *